US009470066B2

(12) United States Patent
Fontenelle et al.

(10) Patent No.: US 9,470,066 B2
(45) Date of Patent: Oct. 18, 2016

(54) SCALE PREVENTION TREATMENT METHOD, SYSTEM, AND APPARATUS FOR WELLBORE STIMULATION

(71) Applicant: Halliburton Energy Services, Inc., Houston, TX (US)

(72) Inventors: Lucas Kurtis Fontenelle, Houston, TX (US); Eli Allen Schnoor, Kingwood, TX (US); Holly Ann Grider, Houston, TX (US); Nathan Carl Schultheiss, Kingwood, TX (US); Todd Anthony Stair, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 426 days.

(21) Appl. No.: 13/872,964

(22) Filed: Apr. 29, 2013

(65) Prior Publication Data

US 2014/0318777 A1 Oct. 30, 2014

(51) Int. Cl.
*E21B 37/06* (2006.01)

(52) U.S. Cl.
CPC ..... *E21B 37/06* (2013.01)

(58) Field of Classification Search
CPC ..... E21B 37/06; E21B 37/08
See application file for complete search history.

(56) References Cited

U.S. PATENT DOCUMENTS 3,891,394 A 6/1975 Smith et al.
4,617,129 A * 10/1986 Lees ..... 210/700
5,310,486 A * 5/1994 Green ..... B01D 61/027 210/638
5,322,121 A 6/1994 Hrachovy
5,893,416 A * 4/1999 Read ..... E21B 37/06 166/228
6,059,034 A 5/2000 Rickards et al.
6,330,916 B1 12/2001 Rickards et al.
2002/0131923 A1 9/2002 Acton et al.
2004/0195182 A1* 10/2004 Elliott ..... B01J 20/26 210/681

(Continued)

FOREIGN PATENT DOCUMENTS

EP 0402996 A1 12/1990
GB 2488630 A 9/2012

(Continued)

OTHER PUBLICATIONS

Fluidized Bed, Thermopedia (last modified Feb. 24, 2011) (available at http://www.thermopedia.com/content/46/?tid=104&sn=1297) (last accessed Jul. 17, 2015).*

(Continued)

*Primary Examiner* — Angela M DiTrani
*Assistant Examiner* — Anuradha Ahuja
(74) *Attorney, Agent, or Firm* — Craig W. Roddy; Baker Botts L.L.P.

(57) ABSTRACT

A method of servicing a wellbore comprising placing a wellbore servicing apparatus into a wellbore, wherein the wellbore servicing apparatus contains a plurality of mobilized template-assisted crystallization beads and contacting a fluid comprising scale-forming ions with at least a portion of the template-assisted crystallization beads. A method of servicing a wellbore, comprising contacting a fluid comprising scale-forming ions with a quantity of template-assisted crystallization beads in a vessel to form a treated fluid, wherein the template-assisted crystallization beds are mobile within the vessel and placing the treated fluid into a wellbore, a subterranean formation, or a combination thereof.

20 Claims, 9 Drawing Sheets

(56) References Cited

U.S. PATENT DOCUMENTS

| | | | | |
|---|---|---|---|---|
| 2006/0243670 | A1* | 11/2006 | Pinchin | C02F 1/688 210/748.11 |
| 2007/0227737 | A1* | 10/2007 | Delaloye | E21B 37/06 166/305.1 |
| 2007/0284100 | A1 | 12/2007 | Collins et al. | |
| 2011/0253634 | A1* | 10/2011 | Soane | C02F 1/28 210/680 |
| 2012/0003135 | A1* | 1/2012 | Vollendorf | C02F 1/5236 423/249 |
| 2012/0138295 | A1* | 6/2012 | Novotny | E21B 43/267 166/280.2 |
| 2012/0181028 | A1 | 7/2012 | Daussin et al. | |
| 2012/0211281 | A1* | 8/2012 | King | B28D 1/14 175/57 |
| 2014/0041869 | A1* | 2/2014 | Weaver | C09K 8/528 166/278 |
| 2014/0041874 | A1* | 2/2014 | Schultheiss | E21B 41/02 166/305.1 |
| 2014/0318762 | A1* | 10/2014 | Fontenelle | C09K 8/52 166/90.1 |

FOREIGN PATENT DOCUMENTS

| | | | |
|---|---|---|---|
| WO | 2014/025649 | A1 | 2/2014 |
| WO | 2014025645 | A1 | 2/2014 |
| WO | 2014025649 | A1 | 2/2014 |

OTHER PUBLICATIONS

"Offshore Northern Europe: Brine mixing complicates Alba field scale management", Oil and Gas Journal, Aug. 27, 2001.*

Foreign communication from a related counterpart application—Invitation to Pay Additional Fees, PCT/US2013/053479, Sep. 24, 2013, 8 pages.

Lower, Stephen, "'Catalytic' Water Treatment," XP-002712649, Apr. 30, 2013, 8 pages, http://www.chem1.com/CQ/catscams.html.

Vastyan, John, "Template-Assisted Crystallization: An Alternative to Salt-Based Water Softening," XP-002712648, Nov. 1, 2010, 4 pages, http://hpac.com/archive/template-assisted-crystallization.

Foreign communication from a related counterpart application—International Search Report and Written Opinion, PCT/US2013/053479, Nov. 13, 2013, 17 pages.

"Filtersorb SP3—Alternative to Domestic & Commercial Water Softeners & Ion-Exchange Resins," XP055096236, May 13, 2011, 15 pages, Manheim, http://www.belkraft.com/FiltersorbSP3Presentation.pdf, WatchWater Technologies.

Foreign communication from a related counterpart application—International Search Report and Written Opinion, PCT/US2013/053434, Jan. 23, 2014, 13 pages.

Office Action dated Aug. 15, 2014 (27 pages), U.S. Appl. No. 13/569,054, filed Aug. 7, 2012.

"High Performance Scale Prevention, (softener-alternative) Media", Retrieved from the Internet: URL:http://www.systematixusa.com/products/downloads/scale%20stop/next-ScaleStop-lit.pdf, Retrieved on Aug. 6, 2014.

"Filtersorb SP3—Alternative to Domestic & Commercial Water Softeners & Ion-Exchange Resins", Retrieved from the Internet: URL:http://www.belkraft.com/Filtersorb SP3 Presentation.pdf, Retrieved on Jan. 14, 2014.

International Search Report and Written Opinion issued in related PCT Application No. PCT/US2014/034976 mailed Jan. 21, 2015, 20 pages.

Filing receipt and specification for patent application entitled "Method and system for servicing a wellbore," by Jimmie D. Weaver, et al., filed Aug. 7, 2012 as U.S. Appl. No. 13/568,977.

Filing receipt and specification for patent application entitled "Wellbore servicing system and methods of use," by Nathan Carl Schultheiss, et al., filed Aug. 7, 2012 as U.S. Appl. No. 13/569,054.

Filing receipt and specification for patent application entitled "Scale prevention treatment method, system, and apparatus for wellbore stimulation," by Lucas Kurtis Fontenelle, et al., filed Apr. 29, 2013 as U.S. Appl. No. 13/873,016.

Johnson, Tod S., et al., "Technical report: nextSand filter media," Jun. 1, 2004, 6 pages, Next™ Filtration Technologies, Inc.

Next™ Filtration Technologies, Inc. case study entitled "Filtration performance and particle analysis, next-Sand vs. MultiMedia," 2010, 1 page.

Next™ Filtration Technologies, Inc. case study entitled "Filtration performance: Turbidity & SDI reduction, particle analysis nextSand vs. MultiMedia," 2010, 1 page.

Next™ Filtration Technologies, Inc. case study entitled "Prefiltration (SDI reduction) for reverse osmosis boiler makeup water system," 2010, 1 page.

Next™ Filtration Technologies, Inc. material safety data sheet, "next-Sand™ (14×40 mesh)," Mar. 2010, 1 page.

Next™ Filtration Technologies, Inc. material safety data sheet, "next-ScaleStop," Mar. 5, 2010, pp. 1-4.

Next™ Filtration Technologies, Inc. document: nextsandlit.pdf entitled "A radically high performance silt, sediment and turbidity media," revised Mar. 5, 2010, 2 pages.

Next™ Filtration Technologies, Inc. document: NSS-7-12-RES-IOM.pdf entitled "Installation, operation and maintenance manual," 2010, pp. 1-11.

Next™ Scale Stop brochure entitled, "Scale and hardness protection with template assisted crystallization," revised Mar. 5, 2010, 2 pages, Next™ Filtration Technologies, Inc.

Smith, Karen R., "Can physical water treatment prevent and control Scale? Exploring a new technology paradigm," Water Conditioning & Purification, Feb. 2007, 5 pages.

Teghidet, Hassiba, et al., "Calcite epitaxy on Au and Ag (1 1 1)," Journal of Crystal Growth, 2011, pp. 72-77, vol. 331, Elsevier B.V.

Watts® test report entitled "A controlled laboratory evaluation of the scale prevention properties of Watts OneFlow technology," Sep. 1996, 10 pages.

Wiest, Mara, et al., "Evaluation of alternatives to domestic ion exchange water softeners," Apr. 26, 2011, 41 pages, Arizona State University.

Zafiropoulou, A., et al., "The effect of benzotriazoles on calcium carbonate scale formation," Journal of Crystal Growth, 2000, pp. 477-480, vol. 219, Elsevier Science B.V.

International Preliminary Report on Patentability issued in related PCT Application No. PCT/US2014/034976 mailed Nov. 12, 2015 (14 pages).

Installation, Operation and Maintenance Manual: ScaleStop Residential Systems, Next™ Filtration Technologies, Inc., © 2006-2010 (12 pages).

Foreign communication from a related counterpart application—Invitation to Pay Additional Fees, PCT/US2014/034976, Aug. 18, 2014, 9 pages.

Next™ Scale Stop brochure entitled, "High performance scale prevention, (softener-alternative) media," revised Mar. 5, 2010, 2 pages, Next™ Filtration Technologies, Inc.

* cited by examiner

SCALE PREVENTION TREATMENT METHOD, SYSTEM, AND APPARATUS FOR WELLBORE STIMULATION

CROSS-REFERENCE TO RELATED APPLICATION

This application is related to commonly owned U.S. patent application Ser. No. 13/873,016, entitled "Scale Prevention Treatment Method, System, and Apparatus for Wellbore Stimulation," filed on the same date as the present application and incorporated by reference herein.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A MICROFICHE APPENDIX

Not applicable.

INCORPORATION-BY-REFERENCE OF MATERIAL SUBMITTED ON A COMPACT DISC

Not applicable.

BACKGROUND

Suitable fluid supplies are sometimes required to prepare wellbore servicing fluids employed in the performance of various wellbore servicing operations. Water supplies may be provided from various sources, such as municipal water, surface water, and flowback water from the wellbore. The water obtained from such sources of water, which will be used in the preparation of a wellbore servicing fluid may include ions, such as scale-forming ions. For instance, flowback water from a subterranean formation may carry with it entrained scale-forming ions from the formation such as, for example, calcium, hydroxide, sulfate, and magnesium. Relatively high concentrations of scale-forming ions may lead to damage to wellbore servicing equipment, for example, through corrosion and/or the formation of scale (e.g., calcite scale, barite scale, magnesium carbonate scale, and the like) on the inner flow surfaces of such wellbore servicing equipment. Accordingly, there is a need for effectively lowering the concentration of ions, such as scale-forming ions, within fluid streams used in the preparation of a wellbore servicing fluid.

SUMMARY

Disclosed herein is a method of servicing a wellbore comprising placing a wellbore servicing apparatus into a wellbore, wherein the wellbore servicing apparatus contains a plurality of mobilized template-assisted crystallization beads, and contacting a fluid comprising scale-forming ions with at least a portion of the template-assisted crystallization beads.

Also disclosed herein, is a method of servicing a wellbore, comprising contacting a fluid comprising scale-forming ions with a quantity of template-assisted crystallization beads in a vessel to form a treated fluid, wherein the template-assisted crystallization beds are mobile within the vessel, and placing the treated fluid into a wellbore, a subterranean formation, or a combination thereof.

Further disclosed herein, is a wellbore servicing apparatus comprising a housing, a mandrel within the housing, an annular space between an outer circumferential surface of the mandrel and an inner circumferential surface of the housing, a plurality of mobilized template-assisted crystallization beads within the annular space, a flowpath between an interior and an exterior of the wellbore servicing apparatus that is in fluid communication with the annular space such that a fluid may flow through the annular space and contact the template-assisted crystallization beads.

Further disclosed herein, is a fluid treatment system comprising a fluid source, a vessel in fluid communication with the fluid source and receiving fluid therefrom, wherein the vessel contains a plurality of mobilized template-assisted crystallization beads, and a wellhead in fluid communication with the vessel and receiving a treated fluid therefrom.

Further disclosed herein, is a wellbore fluid treatment method comprising contacting a wellbore servicing fluid or component thereof with a plurality of mobilized template-assisted crystallization beads such that turbulent fluid flow is induced.

The foregoing has outlined rather broadly the features and technical advantages of the present disclosure in order that the detailed description that follows may be better understood. Additional features and advantages of various embodiments of the disclosure will be described hereinafter that form the subject of the claims of the disclosure. It should be appreciated by those skilled in the art that the conception and the specific embodiments disclosed may be readily utilized as a basis for modifying or designing other structures for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

Figure 1:
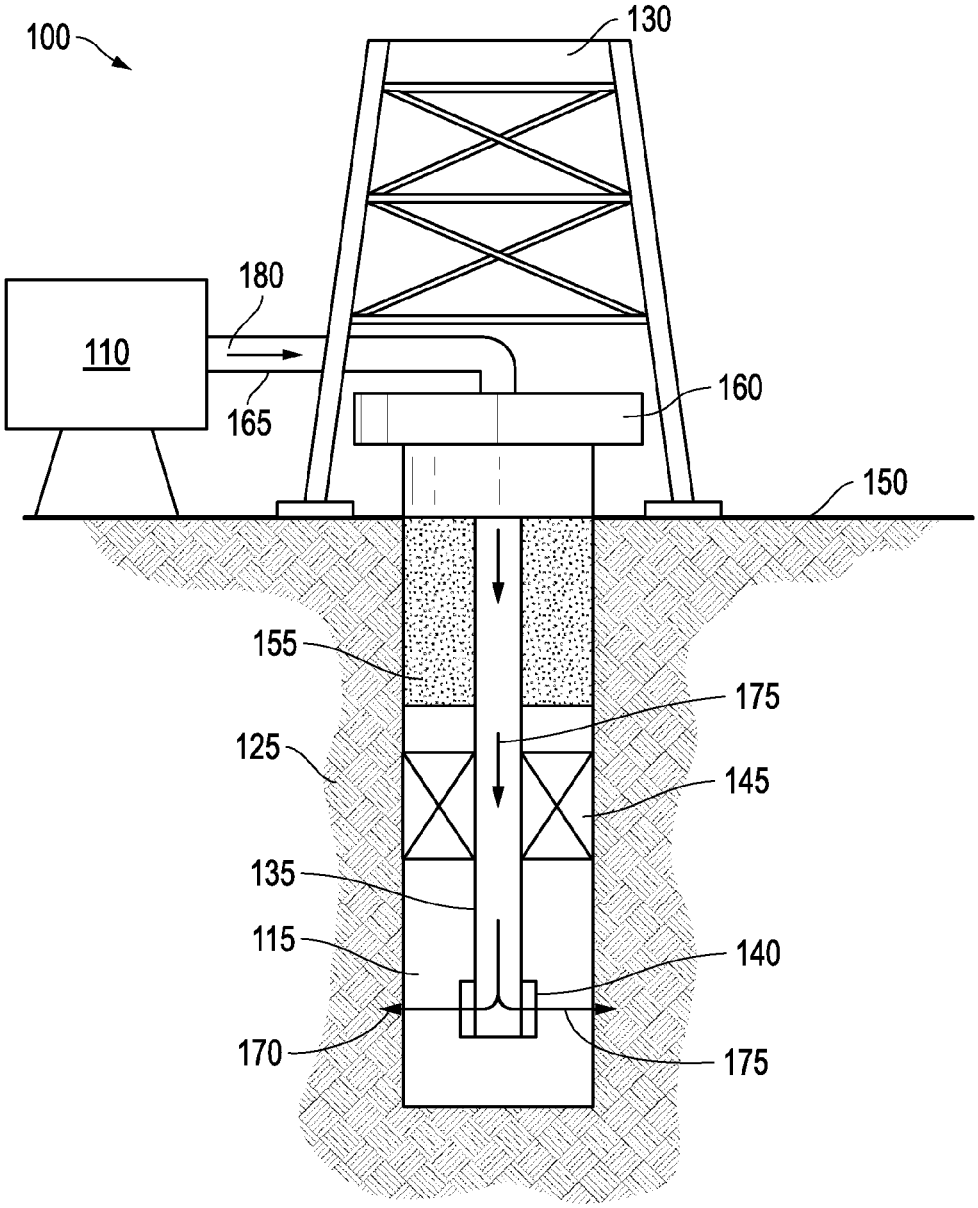
FIG. 1 is a simplified schematic view of a wellbore and a surface wellbore fluid treatment system for the treatment of a wellbore servicing fluid according to an embodiment of the disclosure.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "downhole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Unless otherwise specified, use of the term "wellbore fluid" shall be construed as encompassing all fluids originating from within the wellbore and all fluids introduced or intended to be introduced into the wellbore. Accordingly, the term "wellbore fluid" encompasses, but is not limited to, formation fluids, production fluids, wellbore servicing fluids, the like, and any combinations thereof.

Relatively large amounts of fluid (e.g., water) may be needed for the preparation of wellbore servicing fluids, such as drilling fluid, completion fluid, clean-out fluids, cementitious slurries, stimulation fluids (for example, fracturing and/or perforating fluids), acidizing fluids, gravel-packing fluids, or the like. Common fluid sources used for preparing wellbore servicing fluids include surface water, municipal water, and water co-produced in the production of oil and gas, hereinafter referred to as produced water. Water obtained from one or more of such sources may contain concentrations of dissolved scale-forming ions. The scale-forming ions may include, for example, barium ions, calcium ions, magnesium ions, strontium ions, manganese ions aluminum ions, sulfate ions, hydrogen carbonate ions, carbonate ions, sodium ions, or any combination thereof fluid containing concentrations of dissolved scale-forming ions may adversely affect the intended function of a wellbore servicing fluid formed therefrom and may contribute to the degradation and/or failure of wellbore servicing equipment in contact with the fluid, such as through corrosion and/or the formation of scale (e.g., in the form of calcium, magnesium carbonates, and other scale-forming ions) on flow surfaces of such wellbore servicing equipment. Further, concentrations of such scale-forming ions may adversely affect the intended function of a wellbore servicing fluid and/or render the fluid unusable for use in wellbore servicing operations and/or for use in the production of a wellbore servicing fluid.

Disclosed herein are embodiments of apparatuses, systems, and methods of using the same, as may be useful for effectively lowering the concentration of dissolved ions, such as scale-forming ions, in wellbore fluids that may come in contact with one or more surfaces of wellbore servicing equipment. Particularly, embodiments of wellbore fluid treatment systems and wellbore servicing apparatuses containing template-assisted crystallization beads, methods of using the same, and a wellbore servicing equipment descaling system comprising a surface wellbore fluid treatment system and/or a wellbore servicing apparatus (e.g., downhole tool or apparatus), will be disclosed herein.

In various embodiments disclosed herein, a plurality of TAC beads are disposed within a confined space, but otherwise free to move about and are mobile within the confined space. Such mobilized TAC beads are in contrast to fixed beads such as adhered, coated or otherwise affixed to a surface or structure. In some embodiments, the mobilized TAC beads form a moving, percolating, or fluidized bed within a confined space. Such mobilized TAC beads are effective to induce turbulent fluid flow and perturbation there through which aids in the effectiveness of the TAC beads in reducing scaling over time.

FIG. 1 schematically illustrates an embodiment of an environment in which a surface wellbore fluid treatment (SWFT) system 110, a wellbore servicing apparatus 140 (e.g., a downhole tool or apparatus), or a combination thereof may be deployed. In the embodiment of FIG. 1, such an operating environment comprises a wellsite 100 including a wellbore 115 penetrating a subterranean formation 125 for the purpose of recovering hydrocarbons, storing hydrocarbons, disposing of carbon dioxide, injecting wellbore servicing fluids, or the like. In the embodiment of FIG. 1, a SWFT system 110 for the treatment of a wellbore servicing fluid (WSF) and/or a component thereof (e.g., water) is deployed at a wellsite 100 and is fluidly coupled to the wellbore 115 via a wellhead 160. The wellbore 115 may be drilled into the subterranean formation 125 using any suitable drilling technique. In an embodiment, a drilling or servicing rig 130 may generally comprise a derrick with a rig floor through which a tubular string 135 (e.g., a drill string; a work string, such as a segmented tubing, coiled tubing, jointed pipe, or the like; a casing string; or combinations thereof) may be lowered into the wellbore 115. A wellbore servicing apparatus 140 configured for one or more wellbore servicing operations (e.g., a cementing or completion operation, a clean-out operation, a perforating operation, a fracturing operation, production of hydrocarbons, etc.) may be integrated within the tubular string 135 for the purpose of performing one or more wellbore servicing operations. Additional downhole tools may be included with and/or integrated within the wellbore servicing apparatus 140 and/ or the tubular string 135, for example, one or more isolation devices 145 (for example, a packer, such as a swellable or mechanical packer) may be positioned within the wellbore 115 for the purpose of isolating a portion of the wellbore 115.

The drilling or servicing rig may be conventional and may comprise a motor driven winch and other associated equipment for lowering the tubular string 135 and/or wellbore servicing apparatus 140 into the wellbore 115. Alternatively, a mobile workover rig, a wellbore servicing unit (e.g., coiled tubing units), or the like may be used to lower the tubular string 135 and/or wellbore servicing apparatus 140 into the wellbore 115 for the purpose of performing a wellbore servicing operation.

The wellbore 115 may extend substantially vertically away from the earth's surface 150 over a vertical wellbore portion, or may deviate at any angle from the earth's surface 150 over a deviated or horizontal wellbore portion. Alternatively, portions or substantially all of the wellbore 115 may be vertical, deviated, horizontal, and/or curved. In some instances, a portion of the tubular string 135 may be secured into position within the wellbore 115 in a conventional manner using cement 155; alternatively, the tubular string 135 may be partially cemented in wellbore 115; alternatively, the tubular string 135 may be uncemented in the wellbore 115. In an embodiment, the tubular string 135 may comprise two or more concentrically positioned strings of pipe (e.g., a first pipe string such as jointed pipe or coiled tubing may be positioned within a second pipe string such as casing cemented within the wellbore). It is noted that although one or more of the figures may exemplify a given operating environment, the principles of the devices, systems, and methods disclosed may be similarly applicable in other operational environments, such as offshore and/or subsea wellbore applications.

In an embodiment, the SWFT system 110 may be coupled to the wellhead 160 via a conduit 165, and the wellhead 160 may be connected to (e.g., fluidly) the tubular string 135. In various embodiments, the tubular string 135 may comprise a casing string, a liner, a production tubing, coiled tubing, a drilling string, the like, or combinations thereof. The tubular string 135 may extend from the earth's surface 150 downward within the wellbore 115 to a predetermined or desirable depth, for example, such that the wellbore servicing apparatus 140 is positioned substantially proximate to a portion of the subterranean formation 125 to be serviced (e.g., into which a fracture 170 is to be introduced). Flow arrows 180 and 175 indicate a route of fluid communication from the SWFT system 110 to the wellhead 160 via conduit 165, from the wellhead 160 to the wellbore servicing apparatus 140 via tubular string 135, and from the wellbore servicing apparatus 140 into the wellbore 115 and/or into the subterranean formation 125 (e.g., into fractures 170). The wellbore servicing apparatus 140 may be configured to perform one or more servicing operations, for example, fracturing the formation 125, hydrajetting and/or perforating casing (when present) and/or the formation 125, expanding or extending a fluid path through or into the subterranean formation 125, producing hydrocarbons from the formation 125, or other servicing operation. In an embodiment, the wellbore servicing apparatus 140 may comprise one or more ports, apertures, nozzles, jets, windows, or combinations thereof suitable for the communication of fluid from a flowbore of the tubular string 135 and/or a flowbore of the wellbore servicing apparatus 140 to the subterranean formation 125. In an embodiment, the wellbore servicing apparatus 140 is actuatable (e.g., opened or closed), for example, comprising a housing comprising a plurality of housing ports and a sleeve being movable with respect to the housing, the plurality of housing ports being selectively obstructed or unobstructed by the sliding sleeve so as to provide a fluid flowpath to and/or from the wellbore servicing apparatus 140 into the wellbore 115, the subterranean formation 125, or combinations thereof. In an embodiment, the wellbore servicing apparatus 140 may be configurable for the performance of multiple wellbore servicing operations.

Figure 2A:
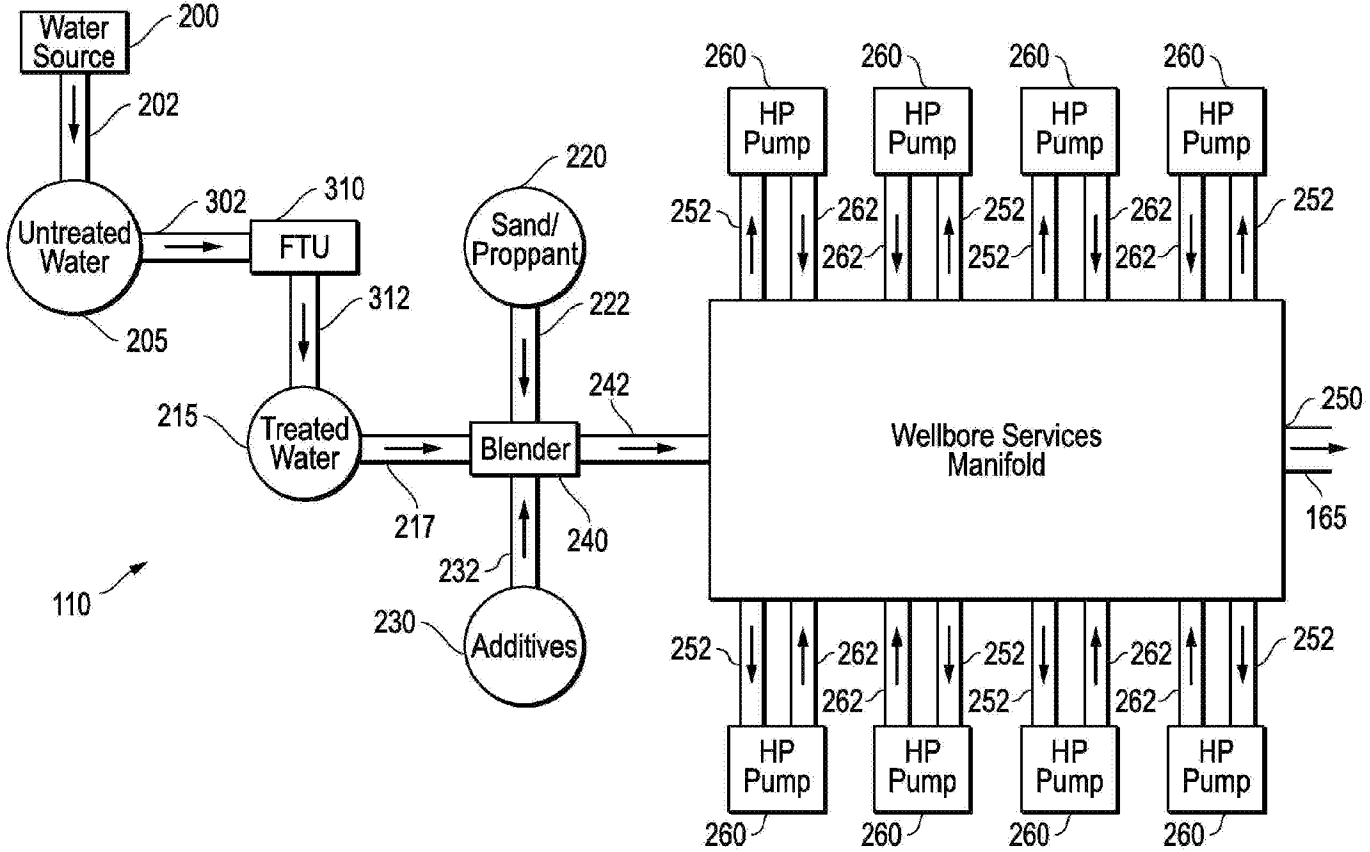
FIG. 2A is a simplified schematic view of a surface wellbore fluid treatment system according to an embodiment of the disclosure.

In an embodiment, the SWFT system 110 generally comprises a flowpath in which a WSF and/or a component thereof is brought into contact with a quantity of template assisted crystallization (TAC) beads. In the embodiment of FIG. 2A, the SWFT system 110 generally comprises a flowpath from (e.g., via fluidly connecting) a fluid source 200 (e.g., a water source), a fluid treatment unit (FTU) 310, one or more storage vessels (such as storage vessels 205, 215, 220, and 230) a blender 240, a wellbore services manifold 250, and one or more high pressure (HP) pumps 260. In additional or alternative embodiments, a SWFT system may comprise any suitable additional components, or any suitable combination of any of these or any additional component. Persons of ordinary skill in the art with the aid of this disclosure will appreciate that the flowpaths described herein may include various configurations of piping, tubing, etc. that are fluidly connected, for example, via flanges, collars, welds, etc. These flowpaths may include various configurations of pipe tees, elbows, and the like. These flowpaths fluidly connect the various WSF process equipment described herein.

In an embodiment, a SWFT system such as SWFT system 110 may be configured for any suitable wellbore servicing operation, such as a drilling operation, a hydrajetting or perforating operation, a remediation operation, a fluid loss control operation, a primary or secondary cementing operation, or combinations thereof. For example, in the embodiment of FIG. 1, the SWFT system is illustrated as configured for a subterranean formation stimulation operation (e.g., perforating and/or fracturing), for example, for initiating, forming, or extending a fracture (such as fractures 170 of FIG. 1) within a hydrocarbon-bearing portion of a subterranean formation (such as subterranean formation 125), or a portion thereof. In such a stimulation operation (e.g., a hydraulic fracturing operation), a WSF, such as a particle (e.g., proppant) laden fluid (e.g., a fracturing fluid), may be introduced, at a relatively high-pressure, into the wellbore 115. The particle laden fluids may then be introduced into a portion of the subterranean formation 125 at a rate and/or pressure sufficient to initiate, create, or extend one or more fractures 170 within the subterranean formation 125. Proppants (e.g., grains of sand, glass beads, shells, ceramic particles, etc.,) may be mixed with the WSF, for example, so as to keep the fractures open (e.g., to "prop" the fractures) such that hydrocarbons may flow into the wellbore 115 so as to be produced from the subterranean formation 125. Hydraulic fracturing may create high-conductivity fluid communication between the wellbore 115 and the subterranean formation 125, for example, to enhance production of fluids (e.g., hydrocarbons) from the formation.

In an embodiment, the fluid source 200 (e.g., a water source) may comprise produced water, flowback water, surface water, a water well, potable water, municipal water, or combinations thereof. For example, in an embodiment the water obtained from the fluid source 200 may comprise produced water that has been extracted from the wellbore 115 while producing hydrocarbons from the wellbore 115. As discussed above, produced water may comprise dissolved scale-forming ions (e.g., calcium ions, magnesium ions, iron ions, strontium ions, manganese ions aluminum ions, sulfate ions, hydrogen carbonate ions, carbonate ions, sodium ions, etc.) and/or other natural or synthetic constituents that are displaced from a hydrocarbon formation during the production of the hydrocarbons or from a wellbore servicing operation. In an additional or alternative embodiment, water obtained from the fluid source 200 may comprise flowback water, for example, water that has previously been introduced into the wellbore 115 during a wellbore servicing operation and subsequently flowed back or returned to the surface. In addition, the flowback water may comprise hydrocarbons, gelling agents, friction reducers, surfactants, and/or remnants of WSFs previously introduced into the wellbore 115 during wellbore servicing operations.

In another additional or alternative embodiment, water obtained from the fluid source 200 may comprise local surface water contained in natural and/or manmade water features (such as ditches, ponds, rivers, lakes, oceans, etc.). Further, water obtained from the fluid source 200 may comprise water obtained from water wells or a municipal source. Water obtained from the fluid source 200 may comprise water that originated from near the wellbore 115 and/or may be water or another liquid (e.g., a non-aqueous fluid) that has been transported to an area near the wellbore 115 from any distance. Still further, water or another fluid obtained from the fluid source 200 may comprise water stored in local or remote containers. In some embodiments, water obtained from the fluid source 200 may comprise any combination of produced water, flowback water, local surface water, municipal water, and/or container-stored water. As discussed earlier, local surface water, municipal water, water from local or remote containers, etc., may also include ions, such as scale-forming ions.

In an embodiment, the water from fluid source 200 of FIG. 2A may be introduced via a conduit 202 into an untreated water storage vessel 205 where it may be temporarily stored prior to being pumped to FTU 310 via a conduit 302. Alternatively, the water may be introduced directly from the fluid source 200 into the FTU 310.

Figure 2B:
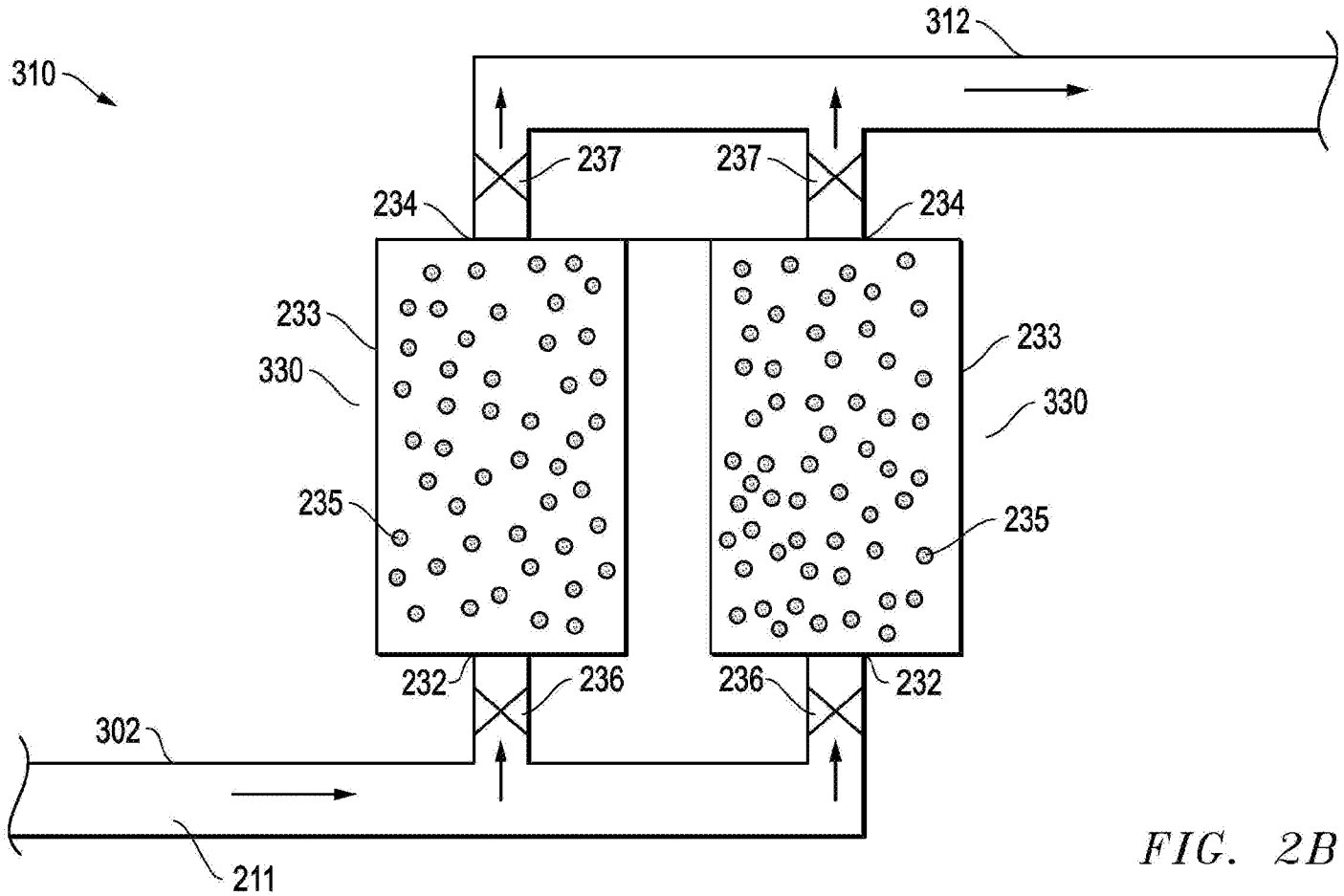
FIG. 2B is a simplified schematic view of a fluid treatment unit according to an embodiment of the disclosure.

In an embodiment, the FTU 310, as will be disclosed herein with reference to FIG. 2B, may be configured to treat a fluid (e.g., water) obtained from the fluid source 200 in order to render the water suitable for use in preparing a WSF and/or for utilization in a wellbore servicing operation. For example, as will be disclosed herein, the FTU 310 may be configured to render inert (e.g., by converting into crystals) scale-forming ions that may negatively affect the performance of the wellbore servicing equipment that the water contacts. In an embodiment, after treatment via the FTU 310, the water may be introduced via a conduit 312 into an intermediate storage vessel 215 for treated water. Alternatively, the water may be routed to one or more other components of the SWFT system 110 or may be used immediately (e.g., treated and used in real time) in forming a WSF.

In the embodiment of FIG. 2A, the water may be introduced into a mixer or blender 240 from a storage vessel (e.g., the intermediate storage vessel 215 in the embodiment of FIG. 2A) via a conduit 217. Alternatively, the water may be introduced into the blender 240 directly from the FTU 310. In an embodiment, the blender 240 may be configured to mix solid and fluid components to form a well-blended WSF. As depicted in the embodiment of FIG. 2A, water from a storage vessel (e.g., storage vessel 215), a WSF component from storage vessel 220, and one or more other components such as additives from storage vessel 230 may be fed into the blender 240 via conduits 217, 222 and 232, respectively. The blender 240 may comprise any suitable type and/or configuration of blender. The mixing conditions of the blender 240, including time period, agitation method, pressure, and temperature of the blender 240, may be chosen by one of ordinary skill in the art with the aid of this disclosure to produce a homogeneous blend having a desirable composition, density, and viscosity. In alternative embodiments, however, sand or proppant (e.g., WSF components), water, and additives may be premixed and/or stored in a storage tank before entering the blender 240. For example, in an embodiment an Advanced Dry Polymer (ADP) blender may be utilized to dry blend one or more dry components, which may then be dry fed into the blender 240. In another embodiment, additives may be pre-blended with water or other liquids, for example, using a GEL PRO blender, which is a commercially available from Halliburton Energy Services, Inc., to form a liquid gel concentrate that may be fed into the blender 240. In the embodiment of FIG. 2A, the blender 240 is in fluid communication with a wellbore services manifold 250 via a conduit 242.

In the embodiments of FIG. 2A, the WSF may be introduced into the wellbore services manifold 250 from the blender 240 via conduit 242. As used herein, the term "wellbore services manifold" may include a mobile vehicle, such as a truck and/or trailer, comprising one or more manifolds for receiving, organizing, and/or distributing WSFs during wellbore servicing operations. In the embodiment illustrated by FIG. 2A, the wellbore services manifold 250 is coupled to eight HP pumps 260 via outlet conduits 252 and inlet conduits 262. In alternative embodiments, however, there may be more or fewer HP pumps 260 used in a wellbore servicing operation. The HP pumps 260 may comprise any suitable type of high pressure pump, a non-limiting example of which is a positive displacement pump. Outlet conduits 252 are outlet lines from the wellbore services manifold 250 that supply fluid to the HP pumps 260. Inlet conduits 262 are inlet lines from the HP pumps 260 that supply fluid to the wellbore services manifold 250. In an embodiment, the HP pumps 260 may be configured to pressurize the WSF to a pressure suitable for delivery into the wellhead 160. For example, the HP pumps 260 may increase the pressure of the WSF to a pressure of about 10,000 p.s.i., alternatively, about 15,000 p.s.i., alternatively, about 20,000 p.s.i. or higher.

From the HP pumps 260, the WSF may reenter the wellbore services manifold 250 via inlet conduits 262 and be combined so that the WSF may have a total fluid flow rate that exits from the wellbore services manifold 250 through conduit 165 to the wellbore 115 of between about 1 BPM to about 200 BPM, alternatively from between about 50 BPM to about 150 BPM, alternatively about 100 BPM.

In an embodiment, the WSF comprises a quantity of at least one WSF additive, for example, depending on the wellbore servicing operation. For example, in an embodiment where the wellbore servicing operation comprises a hydraulic fracturing operation, the at least one WSF component may comprise a quantity of proppant. Nonlimiting examples of suitable proppants include resin coated or uncoated sand, sintered bauxite, ceramic materials, glass beads, ground shells, fruit pits, or hulls, resin coated ground shells, fruit pits or hulls, plastics, or combinations thereof. In an embodiment, the proppant may be present within the WSF (e.g., a fracturing fluid) in a range from about 0.1 pounds of proppant per gallon of fracturing fluid to about 25 pounds of proppant per gallon of fracturing fluid, alternatively, from about 0.5 pounds/gallon to about 10 pounds/ gallon, alternatively, from about 3 pounds/gallon to about 8 pounds/gallon. In an embodiment, the proppant may be present within the WSF (e.g., a fracturing fluid) in a range from about 1 pounds of proppant per gallon of fracturing fluid to about 10 pounds of proppant per gallon of fracturing fluid, alternatively, from about 3 pounds/gallon to about 8 pounds/gallon, alternatively, from about 5 pounds/gallon to about 6 pounds/gallon.

In an alternative embodiment, for example, in an embodiment where the wellbore servicing operation comprises a gravel-packing operation, the at least one WSF component may comprise a quantity of gravel. The gravel particles are sized such that they are small enough to ensure that sand from the formation cannot penetrate the gravel pack formed by the WSF (e.g., a gravel-packing fluid). In an embodiment, the gravel may be present in the WSF (e.g., a gravel-packing fluid) in a range from about 0.1 pounds of gravel per gallon of gravel packing fluid to about 15 pounds of gravel per gallon of gravel-packing fluid, alternatively, from about 1 pound/gallon to about 12 pounds/gallon, alternatively, from about 5 pounds/gallon to about 8 pounds/gallon.

In other alternative embodiments, the WSF may comprise any suitable additional type or formulation of fluid as may be suitable for use in a wellbore servicing operation, such as a drilling operation, a hydrajetting or perforating operation, a remediation operation, a fluid loss control operation, a primary or secondary cementing operation, or combinations thereof. For example, in an embodiment, the WSF may comprise a drilling fluid, a hydrajetting or perforating fluid, a fluid loss control fluid, a remedial fluid, a sealant composition, a cementitious slurry, or combinations thereof. One of skill in the art, upon viewing this disclosure, will recognize one or more WSF components that may be included within the WSF to yield a WSF (for example, of the types set forth herein) so as to be suitable for use in the performance of a wellbore servicing operation.

In an embodiment, the WSF may further comprise one or more additives. In an embodiment, the one or more additives may comprise any suitable additive or combination of additives. Nonlimiting examples of such additives include, but are not limited to, polymers, crosslinkers, friction reducers, defoamers, foaming surfactants, fluid loss agents, weighting materials, latex emulsions, dispersants, vitrified shale and other fillers such as silica flour, sand and slag, formation conditioning agents, hollow glass or ceramic beads, elastomers, carbon fibers, glass fibers, metal fibers, minerals fibers, of combinations thereof. One of skill in the art will appreciate that one or more of such additives may be added, alone or in combination, and in various suitable amounts to yield a WSF of a desired character and/or composition.

In an embodiment, the WSF is delivered into either a subterranean formation (e.g., formation 125), a wellbore formed within the subterranean formation (e.g., wellbore 115), or both. In an embodiment, the step of delivering the WSF into the wellbore, the subterranean formation, or both may comprise pressurizing the WSF for example, via the operation one or more high-pressure pumps (e.g., HP pump 260) and a wellbore manifold (e.g., wellbore services manifold) to a pressure suitable for performing the wellbore servicing operation.

For example, in an embodiment where the WSF is utilized in the performance of a fracturing operation, the WSF may be delivered at a pressure and rate sufficient to form or extend a fracture (e.g., fracture 170) in a subterranean formation and to deposit a proppant layer or bed (e.g., comprising TAC beads) therein. In another embodiment where the WSF is utilized in the performance of a gravel packing operation, the WSF may be delivered into the wellbore at a pressure and rate suitable for forming a gravel pack (e.g., gravel pack 182) comprising the WSF and TAC beads within the wellbore.

In the embodiment of FIG. 2A, the SWFT system 110 comprises a FTU, for example, a fluidized bed FTU (FBFTU) 310 such as shown in FIG. 2B. In an embodiment, the FBFTU 310 may be configured to contact a fluid (e.g., from fluid source 200, such as water) and a quantity of TAC beads, for example, at a rate and/or ratio sufficient to render inert at least a portion of one or more ionic constituents (e.g., scale-forming ions) therefrom. For example, in an embodiment, the FBFTU 310 is configured to lower the concentration of dissolved ions, such as scale-forming ions, within a fluid (e.g., from fluid source 200) introduced to the FBFTU 310. The FBFTU 310 may be configured to lower the concentration of dissolved ions, such as scale-forming ions, within a fluid without injecting or dispersing any other fluid or chemical reactant (e.g., a water softener) into the fluid stream introduced to the FBFTU 310. Additionally, in an embodiment the FBFTU 310 may be configured to retain the TAC beads within the FBFTU 310.

The FBFTU 310 may be configured to contact a fluid (e.g., from fluid source 200, such as water) and a quantity of template-assisted crystallization beads 235, for example, at a rate and/or ratio sufficient to form a fluidized bed between the fluid and the template assisted crystallization beads 235 and sufficient to render inert at least a portion of one or more ionic constituents therefrom. In an embodiment, the one or more ionic constituents comprise one or more species of scale-forming ions. For example, in an embodiment, the FBFTU 310 is configured to lower the concentration of scale-forming ions within a fluid (e.g., from fluid source 200) introduced to the FBFTU 310. Scale-forming ions suitable for treatment include, but are not limited to calcium ions, magnesium ions, strontium ions, manganese ions aluminum ions, sulfate ions, hydrogen carbonate ions, carbonate ions, sodium ions, or any combination thereof. Particularly, in an embodiment as will be disclosed herein, the FBFTU 310 may be configured to lower the concentration of scale-forming ions within a fluid without injecting or dispersing any other fluid or chemical reactant (e.g., a water softener) into the fluid stream introduced to the FBFTU 310. Additionally, in an embodiment the FBFTU 310 may be configured to retain the template assisted crystallization beads 235 within the FBFTU 310 while allowing wellbore fluids, additives, particulate additives having sizes smaller than the template assisted crystallization beads, or any combination thereof to enter FBFTU 310, contact TAC beads 235, and then exit FBFTU 310.

Referring to FIG. 2B, an embodiment of the FBFTU 310 is illustrated. In the embodiment of FIG. 2B, the FBFTU 310 generally comprises at least one vessel 330 including a plurality of TAC beads 235. For example, in the embodiment of FIG. 2B, the FBFTU 310 comprises two vessels 330; alternatively, a FBFTU may comprise any suitable number of vessels (e.g., one, three, four, five, six, seven, eight, nine, ten, or more vessels). In the embodiment of FIG. 2B, the vessels 330 are arranged in parallel; alternatively, a plurality of vessels may be configured in any suitable arrangement (e.g., in series, or both in series and in parallel). In an embodiment, vessels 330 may be oriented vertically, horizontally, or a combination thereof with respect to the surface (e.g., the earth's surface 150). In an embodiment, the vessels 330 may be situated on a common structural support, alternatively multiple, separate structural supports.

Examples of a suitable structural support or supports for these units may include a trailer, truck, skid, barge or combinations thereof.

In the embodiment of FIG. 2B, an untreated fluid stream 211 may be introduced into the vessels 330 of FBFTU 310 via the conduit 302. In an embodiment, each of the one or more vessels 330 generally comprises a housing 233 having a cross-sectional area and containing a quantity of TAC beads 235. The vessels may comprise one or more inlets 232 and one or more outlets 234. In such an embodiment, the vessels 330 are configured such that the TAC beads 235 may move freely within the confines of vessels 330 and come into contact with the untreated fluid stream 211. Also, in such an embodiment, each of the vessels 330 is configured to retain the quantity of TAC beads 235 therein. For example, in the embodiment of FIG. 2B, TAC beads 235 move freely within vessels 330 as they contact untreated fluid stream 211 passing through vessels 330. However, TAC beads 235 are also prevented and/or restricted from leaving vessels 330 with the fluid stream 211 to prevent and/or restrict the loss of any TAC beads, alternatively, the loss of a substantial amount of the TAC beads, therefrom. For instance, the vessels may comprise one or more screens, filters, meshes, supports, trays, or combinations therein, which may be placed within the vessels 330, at an inlet 232 and/or outlet 234 of the vessel, upstream and/or downstream from the vessel 330, or combinations thereof. In such an embodiment, the pore or opening sizes of such a screen, filter, and/or mesh may be chosen based on the sizing, type and/or volume of the TAC beads within the vessel 330. For instance, in an embodiment, the vessels 330 may contain one or more of a screen, filter, filter or mesh which may have pore/opening size ranging from about 60 mesh to about 10 mesh, alternatively, about 48 mesh, about 40 mesh, about 35 mesh, about 32 mesh, about 30 mesh, about 28 mesh, about 24 mesh, about 22 mesh, about 20 mesh, about 18 mesh, about 16 mesh, about 14 mesh, or about 12 mesh, or combinations thereof. As used herein, the term "mesh" refers to the sizing of a material, according to the standardized Tyler mesh size, that will pass through some specific mesh (e.g., such that any particle of a larger size will not pass through this mesh) but will be retained by some specific tighter mesh (e.g., such that any particle of a smaller size will pass through this mesh).

In an embodiment, the vessels 330 may be characterized as being sized, for example, to accommodate a desired flow rate. For example, the vessels may be configured to retain a suitable volume of TAC beads. For example, each of the vessels may comprise TAC beads ranging from about 25 lbs. to about 300 lbs., alternatively, from about 75 lbs. to about 250 lbs., alternatively, from about 125 lbs. to about 200 lbs. In an embodiment, the vessels may be configured to provide contact between a fluid stream being treated and the quantity of TAC beads retained therein at a suitable rate and/or for a suitable duration. For example, the vessels 330 may be characterized as having a flow volume (in which the quantity of TAC beads 235 is retained) having a suitable length, a suitable cross-section area, and a suitable length to cross-sectional area ratio. As will be appreciated by one of skill in the art upon viewing this disclosure, and not intending to be bound by theory, increases in the length of the flow volume of the vessel 330 may generally increase the duration of the exposure (e.g., contact time) of the fluid being treated to the TAC beads (e.g., at a given flow-rate), and increases in the cross-sectional area of the vessel may increase the flow-rate of fluid that may be exposed to the TAC beads. For example, in an embodiment, the flow volume of the vessels 330 may be in the range of from about 10 gal. to about 200 gal., alternatively, from about 50 gal. to about 160 gal., alternatively, from about 90 gal to about 120 gal. Also, in an embodiment the cross-sectional area (e.g., the area of a cross-section generally perpendicular to the direction of fluid flow) of the vessels 330 may be in the range of from about 120 $in^2$ to about 2,000 $in^2$, alternatively, from about 250 $in^2$ to about 1,800 $in^2$, alternatively, from about 450 $in^2$ to about 1,500 $in^2$, alternatively, from about 600 $in^2$ to about 1,000 $in^2$. Also, in an embodiment the ratio of length to cross-sectional area of the flow volume of the vessels 330 may be in the range of from about 2:1 to about 1:150, alternatively, from about 1:4 to about 1:1, alternatively, from about 1:3 to about 1:2. In an embodiment, the flow area of each of the vessels 330 may comprise a suitable volume of TAC beads.

In an embodiment, the FBFTU 310 may be configured such that TAC beads 235 form a fluidized bed with untreated fluid stream 211 as untreated fluid stream 211 passes through vessels 330. Vessel sizes, vessel geometries, TAC bead loadings, values of other process parameters relevant to fluidization bed fluidization, or any combination thereof suitable for achieving fluidization between the TAC beads and an untreated fluid stream at a given fluid flow rate may be determined by one of ordinary skill in the art with the aid of this disclosure. For example, an untreated fluid stream may be flowed via a feed conduit into the bottom of a vertical cylindrical vessel containing TAC beads. By selecting a vessel having an inner diameter of about 6 inches and a height of about 48 inches, a feed conduit having an inner diameter of about 1 inch, and a quantity of the TAC beads in a range of from about 30% to about 75%, a fluidized bed may be achieved at untreated fluid feed rates of about 50 gallons/minute (gal/min). In an embodiment, each of vessels 330 may be loaded with a suitable volume of loose TAC beads to provide optimal fluidization for an anticipated fluid flow rate through vessels 330. For example, the vessels may each comprise a volume of TAC beads of from about 200 $in^3$ to about 18,000 $in^3$, alternatively, from about 720 $in^3$ to about 9,000 $in^3$, alternatively, from about 2,000 $in^3$ to about 6,000 $in^3$. Thus, the FBFTU 310 may be sized to treat a suitable volume of fluid (e.g., untreated water), for example, the FBFTU 310 may be configured for the treatment of from about 100 gal/min to 2,000 gal/min, alternatively, from about 150 gal/min to about 1,000 gal/min. Not wishing to be bound by theory, it is believed that mechanical action of the induced turbulence of the wellbore fluid, alone or further enhanced by fluidized bed conditions, maintains an increased proportion of the crystalline solids in an agitated state. As a result, the crystalline solids remained in solution to a greater extent than, for example, laminar flow regimes, thereby further reducing the formation of scale on pipes and other wellbore servicing equipment that the wellbore fluid comes into contact with.

In an embodiment, each vessel 330 may further include an inlet valve 236 and an outlet valve 237. Inlet valves 236 and outlet valves 237 may allow for the flow rate through each of the vessels 330 to be controlled independently and/or for an individual vessel 330 to be isolated (e.g., allowing for the total flow rate via the FBFTU 310 to be scaled-up or scaled-down and/or allowing for maintenance such as TAC bead change-outs during ongoing fluid treatment operations).

In an embodiment, the FBFTU 310 may further comprise one or more filtration devices, for example, located upstream from the one or more vessels 330. In such an embodiment, the filtration device may be configured to remove particulate material, sediment, or various other contaminants from a fluid stream, for example, prior to introduction of the fluid stream into the vessels 330.

In an embodiment, the pH of the one or more streams may be monitored. For example, in an embodiment, the pH of the untreated fluid stream 211 may be monitored prior to being introduced into the vessels 330. In addition, if the pH of the fluid stream is not within a suitable pH range, the pH of the water may be adjusted. Such a suitable pH may be from about 6.0 to about 9.0, alternatively, from about 6.5 to about 8.5, alternatively, from about 7.0 to about 8.0. In such an embodiment, the pH may be adjusted via the introduction of an additive, such as one or more of various basic and/or acidic compositions, as may be appreciated by one of skill in the art with the aid of this disclosure, for example, to bring the pH of the water stream within the desired pH range.

Referring to FIGS. 2A and 2B, while in the embodiment of FIG. 2A a single FBFTU 310 is shown upstream of the blender 240, in alternative embodiments a plurality of FBFTUs may be employed and/or one or more FBFTUs may be located in alternative positions within the SWFT system 110. For example, one or more FBFTUs may be located upstream of the blender (e.g., as shown in FIG. 2A), one or more FBFTUs may be located downstream of the bender, or both. In an embodiment, one or more FBFTUs are used to form treated water, and the treated water may be used in a variety of additional operations, for example as a component in preparing one or more wellbore servicing fluids (e.g., prepared in blender 240). Additionally or alternative, upon preparation of a WSF or component there (e.g., a treated and/or untreated fluid such as water combined with one or more additional WSF components such as gels, proppants, etc.), such prepared WSF or component thereof may be further treated via a FBFTU of the type described herein. For instance, in an embodiment the FBFTU 310 may be located downstream from a first blender like blender 240 and, optionally, upstream from a second blender. In such an embodiment, a fluid stream comprising one or more pre-blended WSF components may be introduced into the FBFTU 310 for treatment. Also, in such an embodiment, the FBFTU 310 is configured to reduce the concentration of dissolved ions, such as scale-forming ions, within the fluid. Accordingly, FBFTUs of the type described herein may be used to treat a component of a WSF (e.g., water), to treat a WSF (e.g., a fracturing fluid, for example an aqueous gel system prior to addition of proppant), or combinations thereof.

While in the embodiment of FIG. 2B, the FBFTU 310 comprises a vessel 330, in an alternative embodiment the FBFTU 310 may comprise other wellbore servicing equipment configured to provide contact between a fluidized, percolating, or otherwise mobile/moving quantity of TAC beads and a fluid stream (e.g., untreated fluid stream 211). For example, the FBFTU 310 may comprise other types of wellbore servicing equipment that may be configured to contact a fluid stream with a fluidized, percolating, or otherwise mobile/moving quantity of TAC beads, such as a pressure vessel, a water storage tank, or combinations thereof.

In an embodiment, the TAC beads may be effective to reduce the concentration of dissolved ions, such as scale-forming ions (e.g., calcium ions, magnesium ions, iron ions, strontium ions, manganese ions aluminum ions, sulfate ions, hydrogen carbonate ions, carbonate ions, sodium ions, etc.), present within a solution or composition. In an embodiment, the TAC beads may be characterized as having a size (e.g., a diameter) of ranging from about 0.500 millimeters (mm) to about 0.900 mm, alternatively, from about 0.550 mm to about 0.850 mm, alternatively, from about 0.600 mm to about 0.800 mm. In an embodiment, the quantity of beads may be characterized as having a mesh size ranging from about 20/40 mesh to about 16/30 mesh. As used herein, the term "mesh" refers to the sizing of a material, according to the standardized Tyler mesh size, will pass through some specific mesh (e.g., such that any particle of a larger size will not pass through this mesh) but will be retained by some specific tighter mesh (e.g., such that any particle of a smaller size will pass through this mesh.

In an embodiment, the TAC beads generally comprise a generally spheroidal body having an outer surface. The generally spheroidal body may comprise a polymeric material. For example, in an embodiment, the generally spheroidal body of the TAC beads comprises a modified acrylic copolymer, a modified styrenic copolymer, or combinations thereof. Examples of a suitable modified styrenic or acrylic copolymer include, but are not limited to, poly(styrene-co-styrene sulfonate), poly(methyl acrylate), polymethyl methacrylate (PMMA), poly(butyl acrylate), polyvinyl acetate, and combination thereof. Not intending to be bound by theory, in an embodiment, at least a portion (for example, at least 50%, alternatively, at least 60%, 70%, 80%, 90%, or 95%) of the TAC beads may be crosslinked with diacrylates, for example, so as to increase the geometric integrity of the TAC beads. In an embodiment, the outer, generally spheroidal surface of a given TAC bead may comprise a plurality of templates (e.g., dimples) disposed on and/or at least partially within the outer surface of the generally spheroidal body (e.g., similar in appearance to a golf ball). In an embodiment, the templates may comprise a curved, concave surface geometry. The templates may be distributed about the surface of the spheroidal body in various configurations. For example, the templates may be distributed about the surface of the spheroidal body uniformly, evenly, randomly, or any combination thereof. Not intending to be bound by theory, the surface morphology of the TAC beads, which may comprise a great number of nucleation sites, may contribute to the formation of crystals over the surface of the TAC beads. In an embodiment, the nucleation site may comprise one or more suitable functional moieties, for example, as may contribute to the crystallization of scale-forming ions. Example of suitable functional moieties may include, but are not limited to, carboxylic acid functional moieties, sulfonate functional moieties, or combinations thereof.

Not seeking to be bound by theory, the TAC beads may be configured to convert dissolved scale-forming ions into inert crystalline solids. For example, not intending to be bound by theory, the templates may act as a site for heterogeneous nucleation. For example, the surface geometry of the templates is configured to provide a lower energy path for the formation of a crystalline solid from a plurality of ions through the process of nucleation. During nucleation at or within a template disposed on a TAC bead, a nucleus of solute molecules (e.g., scale-forming ions) is formed and reaches a critical size so as to stabilize within the solvent. Not intending to be bound by theory, once a nucleus has reached the critical size, where the crystalline structure has begun to form, crystal growth of the nucleus may continue until the size of the forming crystal reaches a point where it breaks free from the template of the TAC bead. Once the crystal (e.g., an inert crystalline solid) has broken free from the template, it may continue absorbing other dissolved ions within the solvent, acting as a site for homogenous nucleation. Not intending to be bound by theory, crystals formed from TAC beads may be kept in the fluid stream, and with their presence, may further accelerate the conversion of dissolves ions into crystals within the fluid stream. As such, the quantity of TAC beads may aid in converting dissolved scale-forming ions into inert crystalline solids. An example of suitable TAC beads is commercially available from Next™ Filtration Technologies, Inc. of Lake Worth, Fla. as ScaleStop™. The TAC beads may be provided in a dry form, alternatively, as solution or slurry.

For example, not intending to be bound by theory, the reaction by which an ion is converted into a crystal (e.g., an inert crystalline solid) at a nucleation site of a TAC bead may react according to the formula:

$$Ca^{2+}+2HCO_3 \rightarrow CaCO_3+H_2O+CO_2 \qquad \text{Formula I.}$$

Thus, in the nonlimiting example set forth in Formula I, a cation (e.g., $Ca^{+2}$) is transformed into a crystal (e.g., $CaCO_3$). In addition, the one or more of the products of the reaction set forth in Formula I may react according to the formula:

$$CO_2+H_2O_3 \rightarrow H_2CO_3 \qquad \text{Formula II.}$$

Further, in the nonlimiting example set forth in Formula II, byproducts of the reaction set forth in Formula II (e.g., $H_2O$ and $CO_2$) may react to yield carbonic acid (e.g., $H_2CO_3$), thereby lowering the pH of the fluid stream. In an embodiment, a reduction of the fluid stream pH may lead to dissolution of existing scale. For example, a reduction in the pH of a fluid stream treated with a quantity of TAC beads may dissolve existing scale from at least one surface in fluid communication with a flowpath of the treated fluid. Surfaces that may be in fluid communication with a flowpath of the treated fluid may include, but are not limited to, surfaces of a wellbore, a subterranean formation, a component of wellbore servicing equipment, or any combination thereof.

In an embodiment, the SWFT system may be employed to reduce the rate of accumulation of scale on surfaces of wellbore servicing equipment over time, to reduce the presence of accumulated scale on surfaces of wellbore servicing equipment, or a combination thereof. The SWFT system may also be effective in reducing the rate of scale accumulation, reducing the presence of previously accumulated scale, or a combination thereof, on other surfaces in fluid communication with a fluid treated by the SWFT system including, but not limited to, wellbore surfaces, surfaces of a subterranean formation, or a combination thereof. In an embodiment, the SWFT system may reduce the rate of accumulation of scale on surfaces of wellbore servicing equipment over time, reduce the presence of accumulated scale on surfaces of wellbore servicing equipment, or a combination thereof, without generating a separate waste stream. Although not wishing to be bound by theory, it is believed that the mechanisms utilized by the TAC beads do not require the use of additional harmful chemicals to convert the scale-forming ions into inert crystalline solids or to dissolve pre-existing scale. In contrast, scale reduction and/or prevention treatments utilizing conventional chemical scale inhibitors result in a waste stream. Such waste streams may require additional treatment before being released into the environment, long-term storage, or a combination thereof.

Figure 3:
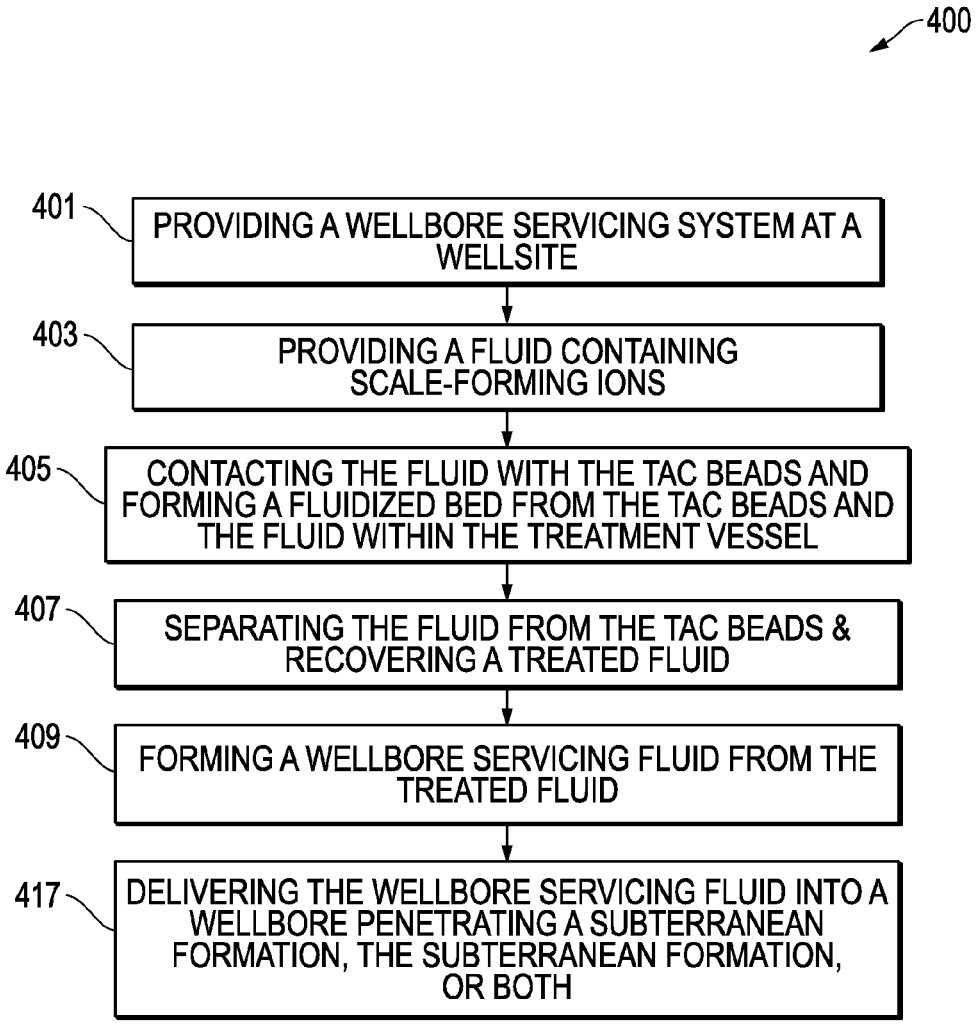
FIG. 3 is a flowchart of a method according to an embodiment of the disclosure.

One or more embodiments of a SWFT system 110 having been disclosed, one or more embodiments of the method of servicing a wellbore utilizing the SWFT system 110 are also disclosed herein. Referring to FIG. 3, a method of servicing a wellbore in accordance with an embodiment of the disclosure is generally described. In an embodiment shown in FIG. 3, the wellbore servicing method 400 begins at step 401, wherein a wellbore servicing system, such as the wellbore servicing system 110 of FIG. 1, is provided, prepared, or otherwise procured at a wellsite. In an embodiment, the step of providing a wellbore servicing system at a wellsite may comprise providing and/or obtaining access to a wellsite such as wellsite 100 of FIG. 1, for example, having a wellbore 115 penetrating a subterranean formation 125 or a portion thereof. In an embodiment, a wellbore 115 may comprise a tubing string like tubing string 135 positioned within the wellbore 115 and a wellhead like wellhead 160 providing access to the tubing string 135. Alternatively, a tubing string may be absent from the wellbore and may later be positioned therein (e.g., via a mobile, coiled-tubing rig or the like), for example, for the purpose of communicating a wellbore fluid, such as a WSF, into the wellbore and/or the formation. In another embodiment, the step of providing a wellbore servicing system at a wellsite may comprise transporting one or more components of the wellbore servicing system to the wellsite. For example, one or more components of wellbore servicing equipment, such as the storage vessels 205, 215, 220, and/or 230, the FBFTU 310, blender 240, the wellbore services manifold 250, the HP pumps 260, various other servicing equipment, or combinations thereof may be transported to or otherwise provided at the wellsite. In such an embodiment, one or more of any such components may be configured for transport, for example one or more of such components may be positioned on a truck, a trailer, a skid, a barge, a boat, or other support thereby rendering the servicing equipment mobile. In yet another embodiment, the step of providing a wellbore servicing system at a wellsite may comprise accessing a fluid source, such as the fluid source 200 illustrated in FIGS. 2A and 2B. In such an embodiment and as noted above, the water from the fluid source 200 may comprise produced water, flowback water from the formation, municipal water, surface water, other sources of water, or combinations thereof. In an alternative embodiment, for example, wherein the fluid further comprises a non-aqueous fluid (e.g., an oleaginous fluid, for example to form an emulsion), the fluid source may comprise a fluid vessel containing a stored fluid. In still another embodiment, the step of providing a wellbore servicing system at a wellsite may comprise fluidly coupling components of the wellbore servicing system (e.g., the storage vessels 205, 215, 220, and/or 230, the FBFTU 310, blender 240, the wellbore services manifold 250, the HP pumps 260, or combinations thereof) to each other, to the fluid source, and/or to the wellbore 115 (e.g., via the wellhead 160), for example, as illustrated in FIGS. 1, 2A, and 2B.

The method 400 may progress to step 403 wherein a fluid (e.g., water) containing scale-forming ions is provided. The fluid may comprise any wellbore servicing fluid and/or component thereof containing scale-forming ions. In an embodiment, the fluid may be a mixture of fluids drawn from two or more fluid sources, wherein at least one of the fluids comprises scale-forming ions. In various embodiments, the fluid may include, but is not limited to, one or more of the fluids described above in connection with fluid source 200. In various embodiments, the fluid may comprise produced water, flowback water, formation fluid, municipal water, surface water or any combination thereof. In an embodiment, at least a portion of the fluid containing scale-forming ions may be provided by producing a fluid from a subterranean formation.

The method 400 may progress to step 405, wherein the fluid is contacted with the TAC beads and a fluidized bed comprising the TAC beads and the fluid is formed. As the fluid passes through the bed of TAC beads, contact of the fluid with the TAC beads results in fluidization, percolation, and/or movement of the beads, thus forming a fluidized bed as the term is understood to those skilled in the art.

The method 400 may progress to step 407, wherein the fluid is separated from the TAC beads and recovered as a treated fluid. For example, the TAC beads may be retained within the contacting vessel, for example via a screen. In an alternative embodiment, any suitable solid-fluid separation device may be employed, for example, a gravity separator or a centrifuge. In an embodiment, TAC beads may exit the top of the vessel along with the treated fluid, and the TAC beads may be separated from the fluid (for example, via gravity) and returned to the vessel and fluidized bed.

The method 400 may progress to step 409, wherein a WSF is formed from the treated fluid. For example, the treated fluid may be combined with a variety of additives and components of the type described herein to produce a WSF suitable for use in a wellbore and/or surrounding formation. The method 400 may progress to step 417, wherein the wellbore servicing fluid is delivered and placed into a wellbore penetrating a subterranean formation, the subterranean formation, or both.

Figure 4A:
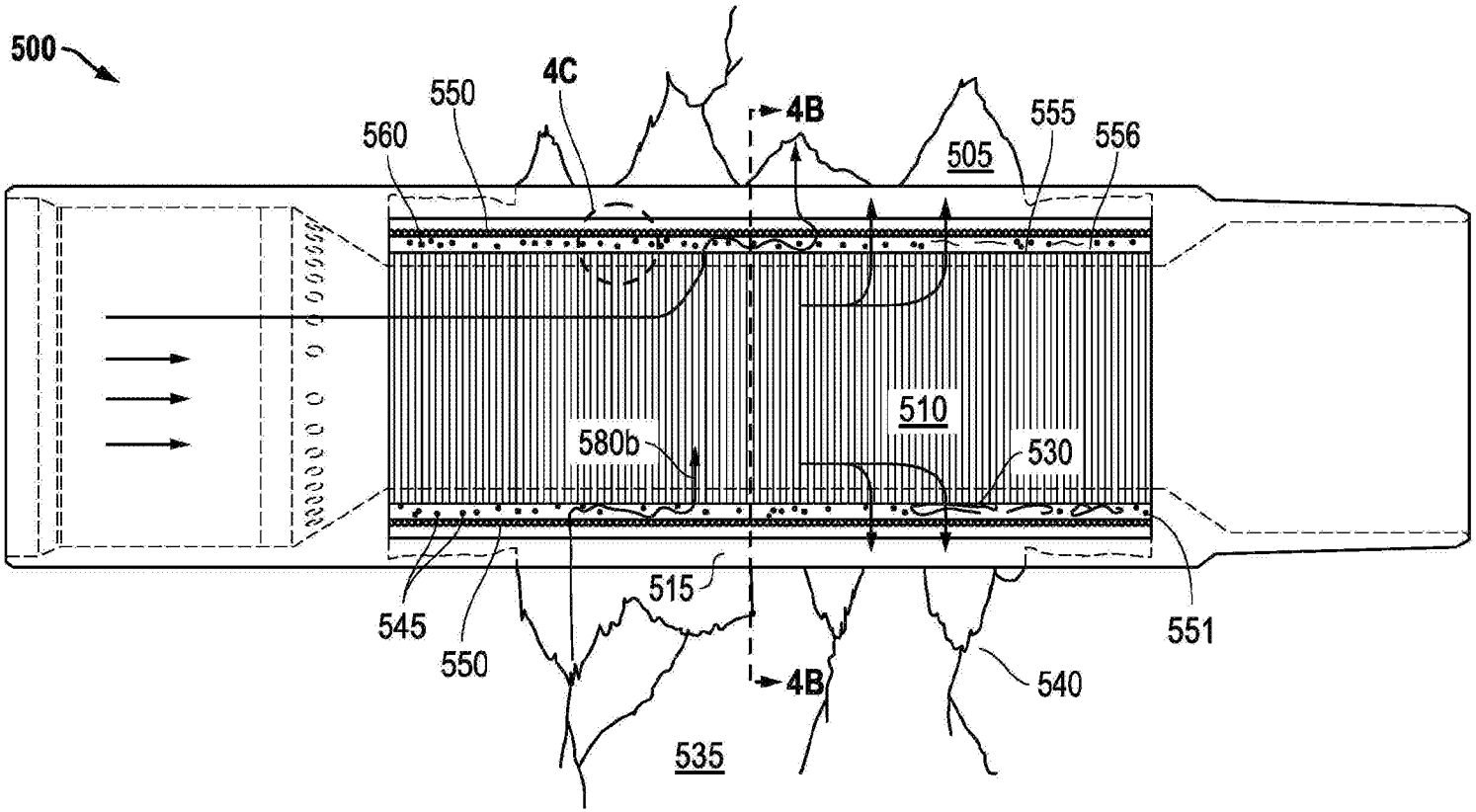
FIG. 4A is a simplified schematic view of a wellbore servicing apparatus according to an embodiment of the disclosure.
Figure 4B:
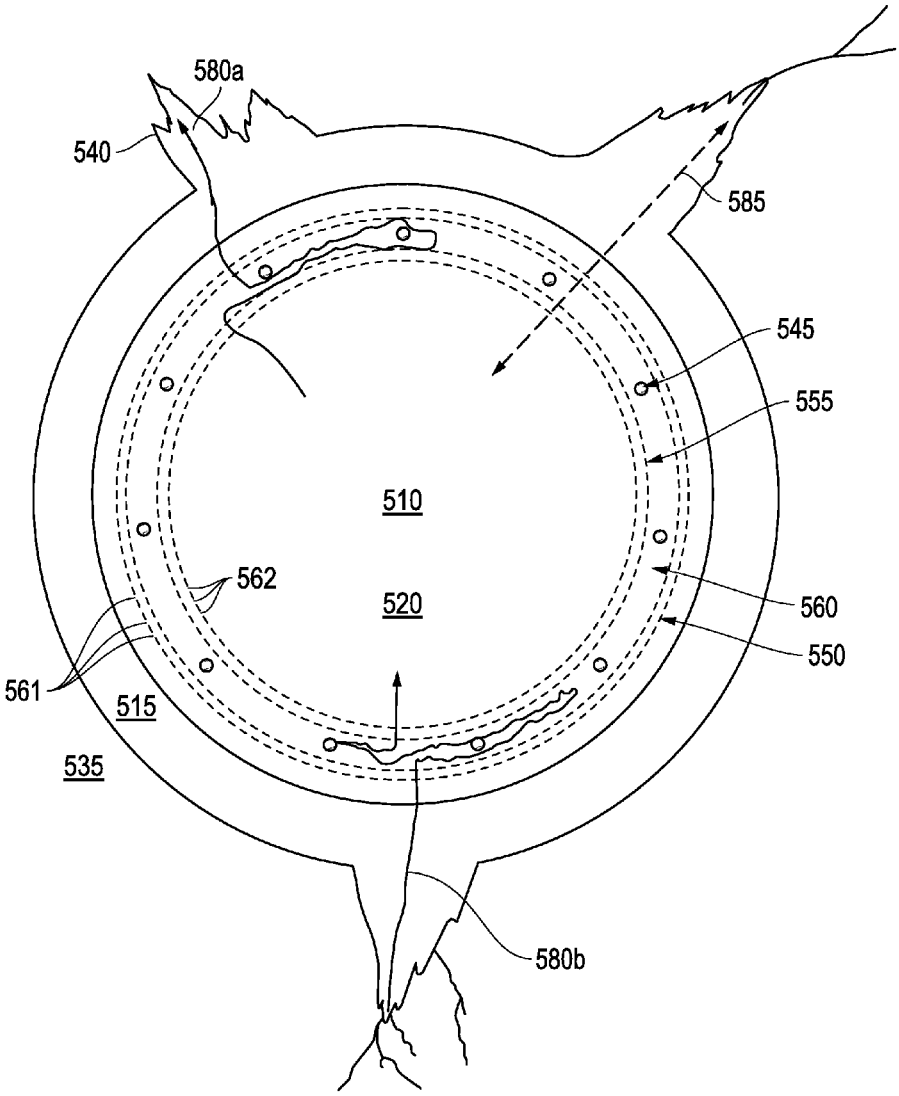
FIG. 4B is a cross-sectional view of the wellbore servicing apparatus of FIG. 4A.

Embodiments of a SWFT system and methods of employing such wellbore fluid treatment systems have been disclosed herein. Also disclosed herein, are embodiments of a wellbore servicing apparatus (e.g., a downhole tool or apparatus) capable of treating wellbore fluids with template-assisted crystallization beads retained therein. Referring to FIGS. 4A-4B, a simplified schematic view of a wellbore servicing apparatus 500 in accordance with an embodiment of the disclosure is shown. The wellbore servicing apparatus 500 may be situated within a wellbore 505 and generally comprises a housing 550 and a mandrel 555 within the housing. The wellbore servicing apparatus 500 may also comprise an annular space 560, which is located between an outer circumferential surface 556 of mandrel 555 and an inner circumferential surface 551 of housing 550. Template-assisted crystallization beads 545 may be retained within annular space 560 such that the TAC beads 545 can move around freely within the confines of the annular space 560. Additionally, in an embodiment the wellbore servicing apparatus 500 may be configured to retain the template assisted crystallization beads within the annular space 560 while allowing produced fluids, wellbore servicing fluids, additives, particulate additives having sizes smaller than the template assisted crystallization beads, or any combination thereof to enter the annular space 560, contact TAC beads 545, and then exit the annular space 560.

Still referring to FIGS. 4A-4B, a flowpath 585 between an interior 520 and an exterior 515 (allowing fluid flow from interior to exterior and/or vice-versa) of the wellbore servicing apparatus 500 may be in fluid communication with the annular space 560 such that fluid may flow through the annular space 560 and contact the TAC beads 545. In various embodiments, the interior 520 of the wellbore servicing apparatus 500 may comprise an inner flowbore 510, which is bounded by an inner circumferential surface 552 of the mandrel 555. In various embodiments, the flow of fluid between the exterior 515 of the wellbore servicing apparatus 500 and the annular space 560 may be facilitated by openings 561, which may extend through housing 550. In various embodiments, the flow of fluid between the inner flowbore 510 and the annular space 560 may be facilitated by openings 562, which may extend through mandrel 555.

Figure 4C:
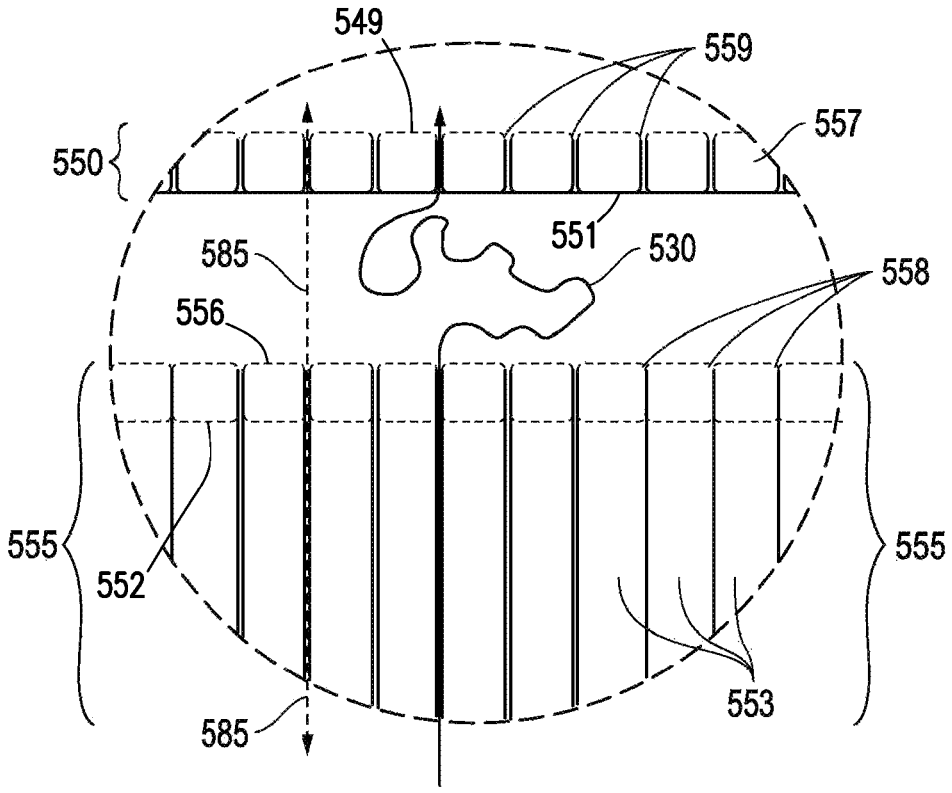
FIG. 4C is a cut-away view of the wellbore servicing apparatus of FIG. 4A.

In an embodiment, the housing 550, the mandrel 555, or both may be porous, perforated, or otherwise constructed such that fluid may readily flow there through. For example, the housing 550, the mandrel 555 or both may be constructed of or comprise perforated pipe, closely spaced tubing/rod rings or a helix of tubing or solid rod (having a structure similar to a compressed coil spring with fluid flow space between closely spaced adjacent coils, referred to herein as helical coiled tubing), a screen, or combinations thereof. Referring to FIG. 4C, the housing 550 may comprise helical coiled tubing 557, and may further comprise a screen on the interior surface 551 and/or outer surface 549. In such an embodiment, interstitial spaces 559 extending between adjacent coils of helical coiled tubing 557 may function as the openings 561 through which fluid may pass. Likewise, mandrel 555 may comprise helical coiled tubing 553, and may further comprise a screen on the interior surface 552 and/or exterior surface 556. In such an embodiment, interstitial spaces 558 existing between and extending through adjacent coils of helical coiled tubing 553 and may function as the openings 562 through which fluid may pass. Suitable screening materials may comprise, for example, 30×0.09 stainless steel wire, and may comprise sieve openings in a range from about 0.15 mm to about 0.5 mm. In some embodiments, the screening material may have pore/opening sizes ranging from about 60 mesh to about 10 mesh, alternatively, about 48 mesh, about 40 mesh, about 35 mesh, about 32 mesh, about 30 mesh, about 28 mesh, about 24 mesh, about 22 mesh, about 20 mesh, about 18 mesh, about 16 mesh, about 14 mesh, or about 12 mesh, or combinations thereof. Suitable helical coiled tubing may comprise, for example, stainless steel rod having a diameter of about 0.25 mm arranged in a tightly wound, closely spaced helix.

Referring again to FIGS. 4A-4B, fluid may flow from the formation/wellbore into the inner flowbore 510 (e.g., a produced fluid such as hydrocarbons and/or water), from the inner flowbore 510 out into the exterior 515 of the wellbore servicing apparatus 500 (e.g., a WSF pumped downhole), or a combination thereof by passing through annular space 560 and openings 561, 562. In an embodiment and as illustrated by flowpath arrow 580*a*, a wellbore servicing fluid containing scale-forming ions (for example, a fracturing fluid) may flow from inner flowbore 510, through annular space 560 and openings 561, 562, and to the exterior 515 of wellbore servicing apparatus 500. The wellbore servicing fluid may further flow from exterior 515 into one or more fractures 540, and possibly even into the unconsolidated portions of the subterranean formation 535 surrounding the one or more fractures 540. In various embodiments, the wellbore fluid flowing into exterior 515 comprises a WSF. Various WSFs suitable for use with various embodiments of the wellbore servicing apparatus, such as the wellbore servicing apparatus 500, are described in more detail herein. In another embodiment and as illustrated by flowpath 580*b* of FIGS. 4A-4B, a formation fluid (e.g., hydrocarbons and/or water) may flow from unconsolidated portions of subterranean formation 535 to exterior 515 of the wellbore servicing apparatus 500 by way of one or more fractures 540. The formation fluid may continue on from exterior 515, through annular space 560 and openings 561, 562, and into inner flowbore 510. Formation fluids, such as a formation fluid following the flowpath illustrated by 580*b*, may present, for example, during a production phase of a wellbore such as wellbore 505.

Still referring to FIGS. 4A-4B, a fluid may contact one or more of TAC beads 545 as the fluid containing scale-forming ions (for example, water produced from a hydrocarbon production well or water from a geothermal well) flows through annular space 560. In various embodiments, the TAC beads 545 induce a turbulent flow 530 of the fluid as the fluid passes through the annular space 560. In various embodiments, the TAC beads 545 contact the fluid passing through the annular space 560 such that a fluidized bed is formed between the TAC beads 545 and the fluid. Annular space sizes, annular space geometries, TAC bead loadings, values of other process parameters relevant to bed fluidization, or any combination thereof suitable for achieving fluidization between the TAC beads and a wellbore fluid stream at a given wellbore fluid flow rate may be determined by one of ordinary skill in the art with the aid of this disclosure. In an embodiment, annular space 560 may be loaded with a suitable volume of loose TAC beads to provide optimal fluidization for an anticipated fluid flow rate through wellbore servicing apparatus 500. As discussed above, the template-crystallization beads may convert at least a portion of the scale-forming ions into inert crystalline solids dispersed freely within the fluid. Not wishing to be bound by theory, it is believed that mechanical action of the fluidized bed allows for breaking off of micro and nano scale mineral particles form the TAC beads, and perturbation of the fluidized bed maintains the crystalline solids in solution to a greater extent than would be possible under, for example, laminar flow conditions. Thus, it is believed that the rendering of the scale-forming ions into inert crystalline solids and the maintaining of those crystalline solids in solution reduces the rate of growth of scale on tubing and on surfaces of other wellbore servicing equipment over time.

In various embodiments, a method of servicing a wellbore is provided that comprises placing a wellbore servicing apparatus containing TAC beads into a wellbore, and contacting a fluid containing scale-forming ions (e.g., a produced fluid such as water, a wellbore servicing fluid or component thereof, or both) with at least a portion of the TAC beads. In an embodiment, TAC beads move freely within a chamber of the wellbore servicing apparatus. In another embodiment, the fluid circulates from a subterranean formation and then through a chamber of the wellbore servicing apparatus containing the TAC beads. In yet another embodiment, the TAC beads induce a turbulent flow of the fluid, form a fluidized bed with the fluid, or a combination thereof. In still another embodiment, a concentration of scale-forming ions in the fluid prior to contacting the TAC beads is greater than about 50 parts per million (ppm). In still another embodiment, a concentration of scale-forming ions in the fluid prior to contacting the TAC beads is reduced by at least 10, 20, 30, 40, 50, 60, 70, 80, or 90% via contact with the TAC beads.

In an embodiment, the wellbore servicing apparatus comprises a packer containing template-assisted crystallization beads within a lining (e.g., an annular space such as annular space 560 described herein) of the packer. In an embodiment, a portion of the packer (e.g., a sub-assembly) of the packer is similar to that shown in FIGS. 4A-C, with additional components such as a plurality of sealing elements and a slip-wedge system for gripping the wellbore and setting the packer. The production packer may be inserted into a wellbore during the course of or in anticipation of a production phase of the wellbore. The production packer may be designed, placed, configured, or any combination thereof such that at least a portion of production fluids emerging from production zones of the subterranean formation of the wellbore pass through the lining (e.g., annular space 560), contact the TAC beads, and form a fluidized bed comprising the production fluids and the TAC beads before flowing to the surface through a production string flowbore. The production packer may be designed, placed, configured, or any combination thereof such that at least a portion of one or more wellbore servicing fluids introduced into the wellbore, the production zone, the subterranean formation, or any combination thereof via the production packer passes through the lining (e.g., annular space 560), contacts the TAC beads, and forms a fluidized bed with the TAC beads. In an exemplary embodiment, the wellbore servicing apparatus 400 is placed within a production zone of a well-bore as a production packer.

Wellbore servicing apparatuses designed, configured, and placed in a wellbore according to various embodiments of the disclosure may present a longer-term solution for reducing, preventing, or reducing and preventing the accumulation of scale on surfaces of wellbore servicing equipment over time in comparison to conventional scale prevention measures, such as the administration of scale inhibitors. Although not wishing to be bound by theory, it is believed that self-regenerating properties of the TAC beads in combination with the scale reducing and/or preventing mechanisms described above (e.g., conversion of the ions to an inert crystalline solid freely suspended within the wellbore fluid) enables various embodiments of the wellbore servicing apparatus disclosed herein to continue over several months. In contrast, conventional chemical scale inhibitors, typically administered as a squeeze treatment in a single administration, provide more limited options for long-term scale-inhibition. Furthermore, scale inhibitors are often chemically incompatible with fracturing fluids introduced into the wellbore as they compete with the zirconium and aluminum based cross-linkers included in the fracturing fluid to facilitate rapid viscosification once the fracturing fluid has been introduced into a wellbore. Thus, wellbore servicing apparatuses according to embodiments of the disclosure present additional advantages over conventional scale inhibition in that neither the TAC beads nor the inert crystalline solids produced therefrom chemically interfere with other aspects of the wellbore operations.

Embodiments of SWFT systems 110 and wellbore servicing apparatuses 500 capable of treating wellbore fluids have been disclosed herein. Also disclosed herein are embodiments wherein at least one embodiment of the SWFT systems and at least one embodiment of the wellbore servicing apparatuses are integrated into a single wellbore servicing system. As used herein, the term "integrated wellbore fluid treatment system" (IWFT system) refers to wellbore servicing systems utilizing at least one SWFT system and at least one wellbore servicing apparatus of the disclosure to treat one or more wellbore fluids comprising scale-forming ions.

Figure 5A:
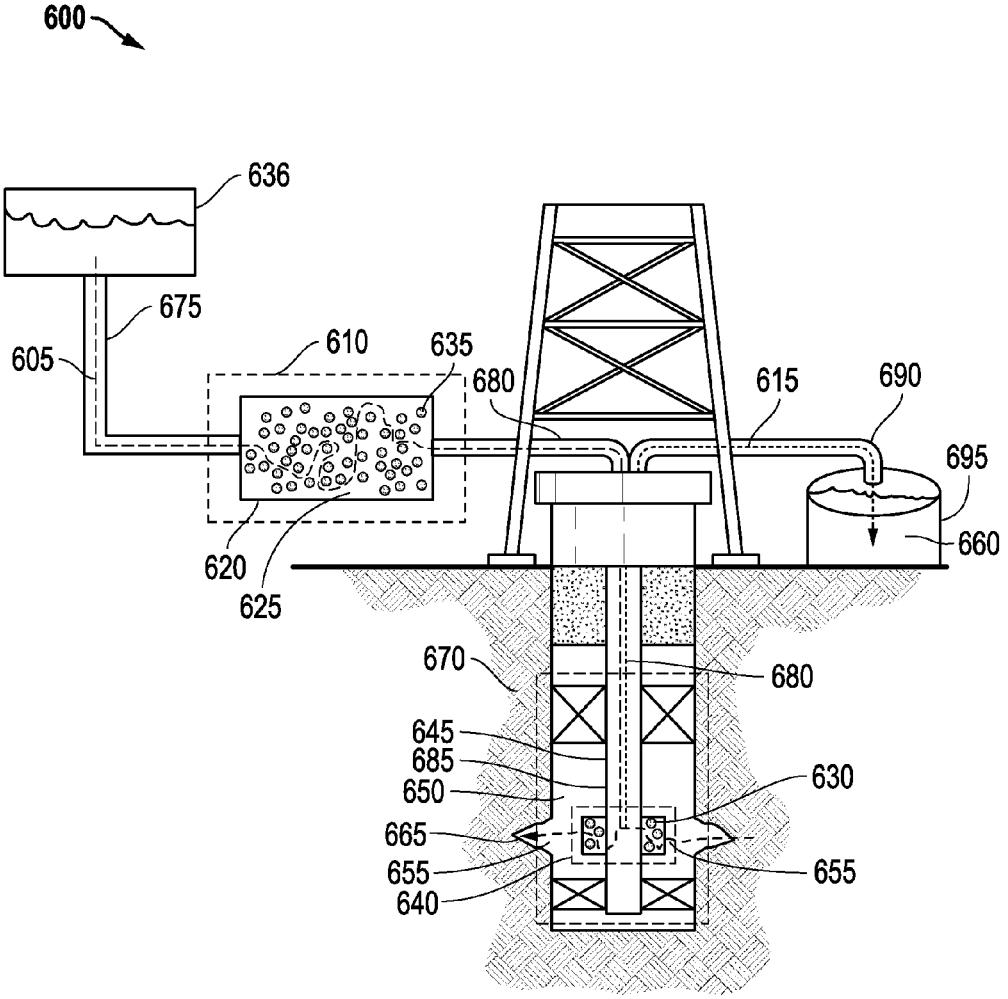
FIG. 5A is a simplified schematic view of an integrated wellbore fluid treatment system according to an embodiment of the disclosure.

Referring now to FIG. 5A, an IWFT system 600 in accordance with an embodiment of the disclosure is shown situated in a wellbore environment similar to the wellbore environment described with respect to FIG. 1. IWFT system 600 generally comprises a SWFT system 610 (for example, similar to SWFT 110 described herein), a first flowpath 605, a wellbore servicing apparatus 640 (for example, similar to wellbore servicing apparatus 500 described herein), and a second flowpath 615. A vessel 620 of the SWFT system 610 and the wellbore servicing apparatus 640 may comprise chambers 625,630, respectively. In an embodiment, the wellbore servicing apparatus 640 comprises a production packer 680 and the chamber 630 is defined by an annular space within the production packer assembly. TAC beads 635 may be contained by but freely disposed within the chamber 625 of the vessel 620, the chamber 630 of the wellbore servicing apparatus 640, or a combination thereof. The first flowpath 605 (e.g., a flowpath for placement of fluid into the wellbore and/or surrounding formation) may establish fluid communication between a fluid source 636 and chamber 625 via a first conduit 675, and between the chamber 625 and the wellbore 650 via a second conduit 680. The second flowpath 615 (e.g., a flowpath for recovery of a fluid from the wellbore and/or the surrounding formation to the surface) may establish fluid communication between a space 655 within the wellbore 650 that is exterior to wellbore servicing apparatus 640 and chamber 630, and between chamber 630 and a flowbore 645 of the wellbore servicing apparatus 640. The second flowpath 615 may further establish fluid communication between space 655 and a space exterior to the wellbore. For example, in an embodiment the second flowpath 615 may establish fluid communication with one or more fractures 665 of subterranean formation 670. The second flowpath 615 may also establish fluid communication between flowbore 645 and a space 660 exterior to the wellbore. Space 660 may be, for example, an open space (e.g., a storage pit, tank, etc.), a space inside wellbore servicing equipment located outside the well, or a combination thereof. In an embodiment, the second flowpath 615 may establish fluid communication between flowbore 645 and a space 660 inside a holding tank 695 via a conduit 690. In an embodiment, the first flowpath 605 may be in fluid communication with the second flowpath 615, for example such that a wellbore servcing fluid (e.g., fracturing fluid) may be formed from water treated via contact with a mobile or fluidized bed of TAC beads, placed downhole, and recovered (and treated via further contact with a mobile or fluidized bed of TAC beads) while being flowed back to the surface from downhole.

Also disclosed herein are embodiments of an IWFT method. As used herein, the term "integrated wellbore fluid treatment method" refers to an embodiment of a wellbore fluid treatment method wherein the number of untreated wellbore fluid flowpaths in a wellbore environment is reduced by treating wellbore fluids at two or more locations. For example, a method utilizing the IWFT system 600 of FIG. 5A is an integrated WFT method in accordance with an embodiment of the disclosure because all flowpaths in fluid communication with flowbore 645 pass through a fluidized bed of TAC beads before entering flowbore 645. Fluids originating from fractures 665 and flowing up through flowbore 645 along the second flowpath 615 are treated by the wellbore servicing apparatus 640 before entering flowbore 645. Likewise, fluid entering flowbore 645 from the surface along flowpath 605 are treated by SWFT system 610 before entering flowbore 645. Without the presence of both SWFT system 610 and wellbore servicing apparatus 640, the inner surfaces 685 of flowbore 645 would be exposed to untreated wellbore fluids passing through flowbore 645 via an untreated wellbore fluid flowpath, which could lead to the formation of scale therein.

Figure 5B:
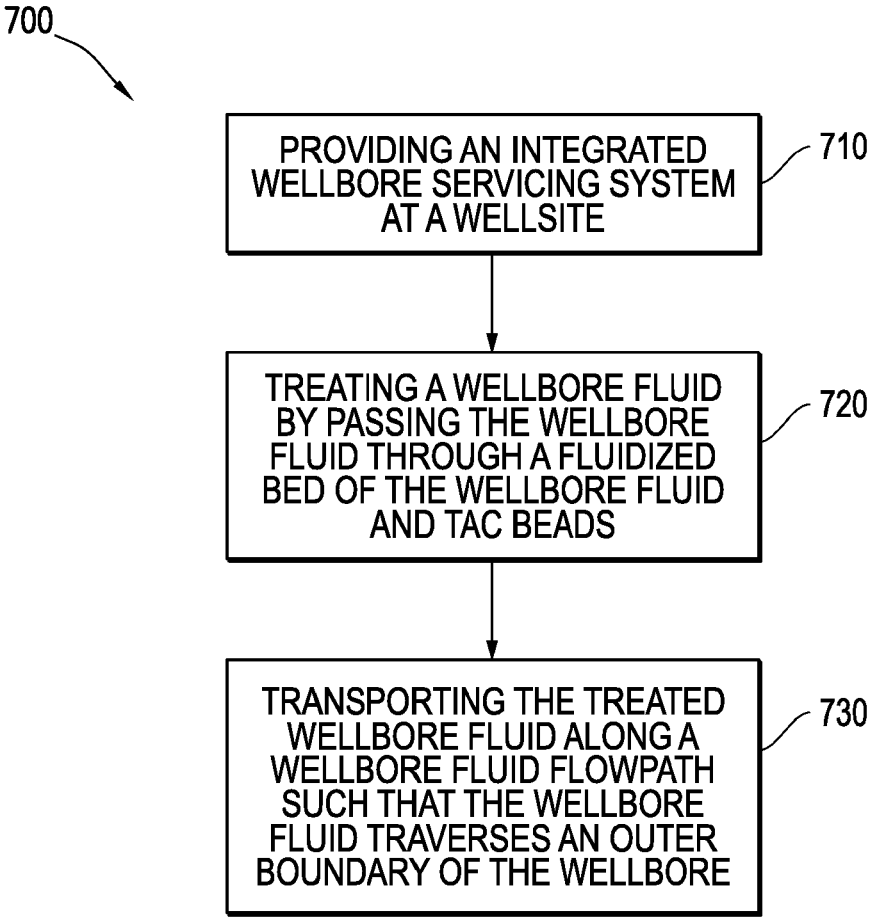
FIG. 5B is a flowchart of a method according to an embodiment of the invention.

Referring to FIG. 5B, an IWFT method 700 in accordance with an embodiment of the disclosure is generally described. The IWFT method 700 may begin at block 710, wherein an integrated wellbore servicing system (e.g., SWFT system 610 and wellbore servicing apparatus 640) is provided at a wellsite. The wellbore servicing system generally comprises at least one SWFT system and at least one wellbore servicing apparatus, each containing TAC beads and made in accordance with an embodiment of the disclosure. In an embodiment, a SWFT comprising an FBFTU made in accordance with an embodiment of the disclosure is provided at a surface location of the wellbore environment and TAC beads are contained by but freely disposed within a chamber of the FBFTU. In an embodiment, TAC beads are contained by but freely disposed within a liner (e.g., annular space or other chamber) of a wellbore servicing apparatus provided at a downhole location inside a wellbore.

The IWFT method 700 may progress to block 720, wherein fluid is treated by passing the fluid through a fluidized bed comprising the fluid and the TAC beads. In an embodiment, two or more fluids may be treated simultaneously, at different times, or a combination thereof. In an embodiment, the FBFTU of the SWFT and the wellbore servicing apparatus may treat fluids simultaneously, at different times, or a combination thereof. In an embodiment, a WSF or component thereof (e.g., water) is treated at the surface, pumped downhole and into the wellbore and/or surrounding formation, and is recovered and treated downhole prior to being flowed back to the surface.

THE IWFT method 700 may progress to block 730, wherein fluid treated according to block 720 is transported along a wellbore fluid flowpath such that the fluid traverses an outer boundary of the wellbore. Examples of an outer boundary of the wellbore include the wellhead (which is an outer boundary of fluid flow from the wellbore) and/or a production zone and/or surrounding formation (which is an outer boundary of fluid flow into the formation via the wellbore). In other words, a fluid is first treated at the surface and/or downhole prior to flowing through a flowpath defined by the wellbore such that scaling within the wellbore (e.g., production tubing and related equipment) is reduced. In an embodiment, a wellbore fluid forms a fluidized bed with TAC beads when passing through a chamber of the FBFTU of the SWFT before traversing an outer boundary of a wellbore. In an embodiment, a wellbore fluid forms a fluidized bed with TAC beads when passing through a chamber (e.g., an annular space) of a wellbore servicing apparatus before passing through the outer boundary of the wellbore.

Advantageously, various embodiments of IWFT systems and methods may be employed to reduce the rate of accumulation of scale on surfaces of wellbore servicing equipment disposed within a wellbore environment over time. Various embodiments of IWFT systems and methods of the disclosure may also advantageously reduce the presence of accumulated scale on surfaces of wellbore servicing equipment by, for example, the mechanism described above in connection with formula I.

In various embodiments of the disclosure, apparatuses, systems, and methods of using the same may utilize mobilized TAC beads (e.g., fluidized beds of TAC beads) to reduce the rate of accumulation of scale, reduce the presence of previously accumulated scale, or a combination thereof, on surfaces wellbore servicing equipment over time. Various apparatuses, systems, and methods disclose herein may utilize mobilized TAC beads (e.g., fluidized beds of TAC beads) to treat wellbore fluids containing quantities of scale-forming ions at concentrations of greater than about 50 ppm. In an embodiment, a method of servicing a wellbore utilizing a FBFTU containing TAC beads, a wellbore servicing apparatus containing TAC beads in a chamber (e.g., a production packer comprising a liner containing TAC beads freely disposed therein) may be utilized to treat wellbore fluids comprising one or more species of scale-forming ions, wherein an initial concentration of the scale-forming ions is greater than about 50 parts per million. In an embodiment, a wellbore fluid containing calcium ions, magnesium ions, or a combination thereof present in concentrations of greater than about 50 ppm may be treated with one or more embodiments of the apparatuses, systems, and methods disclosed herein such that the concentrations may be substantially reduced by converting the ions into inert crystalline solids freely dispersed within the wellbore fluid.

As noted above, a fluid (e.g., water) that contains various contaminants, such as those mentioned above, may adversely affect the intended function of a WSF formed therefrom and/or adversely affect wellbore servicing equipment in contact with such a fluid (e.g., water) and/or such a WSF, such as through the formation of scale on the inner flow surfaces of the wellbore servicing equipment. As disclosed herein, a concentration of scale-forming ions (e.g., calcium ions, magnesium ions, iron ions, strontium ions, manganese ions aluminum ions, sulfate ions, hydrogen carbonate ions, carbonate ions, sodium ions, etc.) may be substantially reduced within a fluid stream, for example, via the systems, apparatuses, and/or methods disclosed herein. For example, as disclosed herein, a concentration of scale-forming ions (e.g., calcium ions, magnesium ions, iron ions, strontium ions, manganese ions aluminum ions, sulfate ions, hydrogen carbonate ions, carbonate ions, sodium ions, etc.) may be substantially reduced within formation fluids produced from a formation, such as formation fluids produced from the subterranean formation 125. Conventional means of reducing the concentration of scale-forming ions, for example, various chemicals, such as water softening chemicals, may also not be effective when included within a WSF and/or may undesirably alter the character or composition of the WSF, and the present disclosure provides a suitable alternative. Further, the addition of such chemicals to a WSF may adversely affect the performance of such a fluid and/or be harmful to the environment. As such, the instantly-disclosed compositions and methods allow for a reduction of scale-forming ions in WSFs (or component fluids thereof) and produced (e.g., formation) fluids, thereby decreasing the incidence of scaling of various servicing equipment, within the wellbore, and/or within the formation. As such, the instantly-disclosed compositions and methods allow for improved productivity of formation fluids and decreased downtime resulting from scaling, corrosion, or other damage due to the presence of scale-forming ions.

ADDITIONAL DISCLOSURE

The following are nonlimiting, specific embodiments in accordance with the present disclosure:

A first embodiment, which is a method of servicing a wellbore, comprising:

placing a wellbore servicing apparatus into a wellbore, wherein the wellbore servicing apparatus contains a plurality of mobilized template-assisted crystallization beads; and contacting a fluid comprising scale-forming ions with at least a portion of the template-assisted crystallization beads.

A second embodiment, which is the method of the first embodiment, wherein the wellbore servicing apparatus comprises a packer and the template-assisted crystallization beads are contained within a chamber of the packer.

A third embodiment, which is the method of one of the first through the second embodiments, wherein the fluid flows from a subterranean formation and then through a chamber of the wellbore servicing apparatus containing the template-assisted crystallization beads.

A fourth embodiment, which is the method of one of the first through the third embodiments, wherein the template-assisted crystallization beads induce turbulent flow of the fluid.

A fifth embodiment, which is the method of one of the first through the fourth embodiments, wherein the mobilized template-assisted crystallization beads form a fluidized bed upon flow of the fluid there through.

A sixth embodiment, which is the method of one of the first through the fifth embodiments, wherein the scale-forming ions comprise calcium, magnesium, strontium, aluminum, hydroxide, sulfate, hydrogen carbonate, carbonate, sodium, or any combination thereof.

A seventh embodiment, which is the method of one of the first through the sixth embodiments, wherein a concentration of the scale-forming ions in the fluid prior to contacting the template assisted crystallization beads is greater than about 50 ppm.

An eighth embodiment, which is the method of one of the first through the seventh embodiments, further comprising converting the scale-forming ions into crystalline solids freely dispersed within the fluid.

A ninth embodiment, which is the method of the eighth embodiment, wherein the crystalline solids are inert.

A tenth embodiment, which is the method of one of the first through the ninth embodiments, wherein the method of servicing a wellbore reduces the rate of accumulation of scale on at least one surface of the wellbore, a subterranean formation, a component of wellbore servicing equipment, or any combination thereof.

An eleventh embodiment, which is the method of one of the first through one of the tenth embodiments, wherein the method of servicing a wellbore reduces accumulated scale on at least one surface of the wellbore, a subterranean formation, a component of wellbore servicing equipment, or any combination thereof.

A twelfth embodiment, which is the method of one of the tenth through the eleventh embodiments, wherein the wellbore servicing equipment comprises piping.

A thirteenth embodiment, which is the method of one of the first through the twelfth embodiments, wherein the template assisted crystallization beads comprise a styrenic polymer, an acrylic polymer, or combinations thereof.

A fourteenth embodiment, which is the method of one of the first through the thirteenth embodiment, wherein the template assisted crystallization beads are configured to provide a plurality of nucleation sites for the crystallization of the scale-forming ions.

A fifteenth embodiment, which is the method of one of the first through fourteenth embodiments, wherein the plurality of nucleation sites comprise carboxylic acid functional moieties, sulfonate functional moieties, or combinations thereof.

A sixteenth embodiment, which is the method of one of the first through the fifteenth embodiments, wherein the template assisted crystallization beads are at least partially self-regenerating A seventeenth embodiment, which is a method of servicing a wellbore, comprising:

contacting a fluid comprising scale-forming ions with a quantity of template-assisted crystallization beads in a vessel to form a treated fluid, wherein the template-assisted crystallization beds are mobile within the vessel; and placing the treated fluid into a wellbore, a subterranean formation, or a combination thereof.

An eighteenth embodiment, which is the method of the seventeenth embodiment, wherein the template-assisted crystallization beads induce turbulent flow of the fluid.

A nineteenth embodiment, which is the method of one of the seventeenth through the eighteenth embodiments, wherein the mobilized template-assisted crystallization beads form a fluidized bed within the vessel.

A twentieth embodiment, which is the method of one of the seventeenth through the nineteenth embodiments, further comprising producing a fluid from the subterranean formation.

A twenty-first embodiment, which is the method of one of the seventeenth through the twentieth embodiments, wherein the fluid comprises at least a portion of the produced fluid from the subterranean formation.

A twenty-second embodiment, which is the method of one of the twentieth through the twenty-first embodiments, further comprising returning the fluid to the subterranean formation.

A twenty-third embodiment, which is the method of one of the seventeenth through the twenty-second embodiments, wherein the fluid comprises a produced water, flowback water, a formation fluid, or a combination thereof.

A twenty-fourth embodiment, which is the method of one of the seventeenth through the twenty-third embodiments, wherein the treated fluid further comprises one or more additional components to form a wellbore servicing fluid.

A twenty-fifth embodiment, which is the method of the twenty-fourth embodiment, wherein wellbore servicing fluid comprises a substantially aqueous fluid, a brine, an emulsion, an invert emulsion, an oleaginous fluid, or combinations thereof.

A twenty-sixth embodiment, which is the method of one of the twenty-fourth through the twenty-fifth embodiments, wherein the wellbore servicing fluid comprises a proppant.

A twenty-seventh embodiment, which is the method of one of the twenty-fourth through the twenty-sixth embodiments, wherein the wellbore servicing fluid comprises a fracturing fluid, a gravel-packing fluid, or combinations thereof.

A twenty-eighth embodiment, which is the method of one of the seventeenth through the twenty-seventh embodiments, wherein the template-assisted crystallization beads reduce the rate of accumulation of scale on one or more surfaces of wellbore servicing equipment over time, reduce the presence of accumulated scale on one or more surfaces of wellbore servicing equipment, or a combination thereof, without generating a separate waste stream.

A twenty-ninth embodiment, which is a wellbore servicing apparatus, comprising: a housing;

a mandrel within the housing;

an annular space between an outer circumferential surface of the mandrel and an inner circumferential surface of the housing;

a plurality of mobilized template-assisted crystallization beads within the annular space;

a flowpath between an interior and an exterior of the wellbore servicing apparatus that is in fluid communication with the annular space such that a fluid may flow through the annular space and contact the template-assisted crystallization beads.

A thirtieth embodiment, which is the apparatus of the twenty-ninth embodiment, wherein the template-assisted crystallization beads are configured to induce a turbulent flow of a wellbore fluid as the wellbore fluid passes through the annular space.

A thirty-first embodiment, which is the apparatus of one of the twenty-ninth through the thirtieth embodiments, wherein the housing comprises helical coiled tubing, a screen, or both.

A thirty-second embodiment, which is the apparatus of one of the twenty-ninth through the thirtieth embodiments, wherein the mandrel comprises helical coiled tubing, a screen, or both.

A thirty-third embodiment, which is a fluid treatment system comprising:

a fluid source;

a vessel in fluid communication with the fluid source and receiving fluid therefrom, wherein the vessel contains a plurality of mobilized template-assisted crystallization beads; and a wellhead in fluid communication with the vessel and receiving a treated fluid therefrom.

A thirty-fourth embodiment, which is the fluid treatment system of the thirty-third embodiment, wherein the template-assisted crystallization beads are configured to induce a turbulent flow of the fluid as the fluid passes through the vessel.

A thirty-fifth embodiment, which is the fluid treatment system of one of the thirty-third through the thirty-fourth embodiments, wherein the mobilized template-assisted crystallization beads form a fluidized bed upon flow of the fluid there through.

A thirty-sixth embodiment, which is a wellbore servicing system, comprising:

a first flowpath, comprising:

a first conduit from a fluid source to a vessel;

a chamber of the vessel; and a second conduit from the chamber within the vessel to a wellbore, a second flowpath, comprising:

a space within the wellbore and exterior to a wellbore servicing apparatus;

a chamber of the wellbore servicing apparatus; and a flowbore of the wellbore servicing apparatus, and a plurality of mobilized template-assisted crystallization beads within the chamber of the vessel, within the chamber of the wellbore servicing apparatus, or a combination thereof.

A thirty-seventh embodiment, which is the system of the thirty-sixth embodiment, wherein the first flowpath is in fluid communication with the second flowpath.

A thirty-eighth embodiment, which is a wellbore fluid treatment method comprising treating a wellbore fluid traversing an outer boundary of a wellbore by passing the wellbore fluid through a plurality of mobilized template-assisted crystallization beads.

A thirty-ninth embodiment, which is the method of the thirty-eighth embodiment, wherein the template-assisted crystallization beads are contained by but freely disposed within a chamber of a surface fluid treatment vessel.

A fortieth embodiment, which is the method of one of the thirty-eighth through the thirty-ninth embodiments, wherein the wellbore fluid forms a fluidized bed with the template-assisted crystallization beads when passing through the chamber and before traversing the outer boundary of the wellbore.

A forty-first embodiment, which is the method of one of the thirty-eighth through the fortieth embodiments, wherein the template-assisted crystallization beads are contained by but freely disposed within a chamber of a wellbore servicing apparatus inside the wellbore.

A forty-second embodiment, which is the method of the forty-first embodiment, wherein the wellbore fluid forms a fluidized bed with the template-assisted crystallization beads when passing through the liner of the wellbore servicing apparatus and before traversing the outer boundary of the wellbore.

A forty-third embodiment, which is a wellbore fluid treatment method comprising contacting a wellbore servicing fluid or component thereof with a plurality of mobilized template-assisted crystallization beads such that turbulent fluid flow is induced.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$ and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, 50 percent, 51 percent, 52 percent, 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A method of servicing a wellbore, comprising:

placing a wellbore servicing apparatus into a wellbore, wherein the wellbore servicing apparatus contains a plurality of mobilized template-assisted crystallization beads;

contacting a fluid comprising scale-forming ions with at least a portion of the template-assisted crystallization beads; and introducing the fluid comprising scale-forming ions into at least a portion of the wellbore at a pressure of about 10,000 psi or greater.

2. The method of claim 1, wherein the wellbore servicing apparatus comprises a packer and the template-assisted crystallization beads are contained within a chamber of the packer.

3. The method of claim 1, wherein the fluid flows from a subterranean formation and then through a chamber of the wellbore servicing apparatus containing the template-assisted crystallization beads.

4. The method of claim 1, wherein the template-assisted crystallization beads induce turbulent flow of the fluid.

5. The method of claim 1, wherein the mobilized template-assisted crystallization beads form a fluidized bed upon flow of the fluid there through.

6. The method of claim 1, wherein a concentration of the scale-forming ions in the fluid prior to contacting the template assisted crystallization beads is greater than about 50 ppm.

7. The method of claim 1, further comprising converting the scale-forming ions into crystalline solids freely dispersed within the fluid.

8. The method of claim 1, wherein the method of servicing a wellbore reduces a rate of accumulation of scale on at least one surface wherein the surface is present in a location selected from the group consisting of: the wellbore, a subterranean formation, a component of wellbore servicing equipment, or any combination thereof; and/or wherein the method of servicing a wellbore reduces accumulated scale on at least one surface wherein the surface is present in a location selected from the group consisting of: the wellbore, a subterranean formation, a component of wellbore servicing equipment, or any combination thereof.

9. The method of claim 1, wherein the template assisted crystallization beads comprise at least one material selected from the group consisting of: a styrenic polymer, an acrylic polymer, or any combination thereof.

10. The method of claim 1, wherein the template assisted crystallization beads are configured to provide a plurality of nucleation sites for crystallization of the scale- forming ions.

11. The method of claim 1, wherein the plurality of nucleation sites comprise at least one moiety selected from the group consisting of: a carboxylic acid functional moiety, a sulfonate functional moiety, or any combination thereof.

12. The method of claim 1, wherein the template assisted crystallization beads are at least partially self-regenerating.

13. The method of claim 1, wherein the fluid comprising scale-forming ions is introduced into at least a portion of the wellbore at a rate of from about 50 BPM to about 200 BPM.

14. A method of servicing a wellbore, comprising:

placing a wellbore servicing apparatus into a wellbore, wherein the wellbore servicing apparatus contains a plurality of mobilized template-assisted crystallization beads;

contacting a fluid comprising scale-forming ions with at least a portion of the template-assisted crystallization beads; and introducing the fluid comprising scale-forming ions into at least a portion of the wellbore at a rate of from about 50 BPM to about 200 BPM.

15. The method of claim 14, wherein the fluid comprising scale-forming ions is introduced into at least a portion of the wellbore at a pressure of about 10,000 psi or greater.

16. The method of claim 14, wherein the fluid flows from a subterranean formation and then through a chamber of the wellbore servicing apparatus containing the template-assisted crystallization beads.

17. The method of claim 14, wherein the template-assisted crystallization beads induce turbulent flow of the fluid.

18. The method of claim 14, wherein the mobilized template-assisted crystallization beads form a fluidized bed upon flow of the fluid there through.

19. The method of claim 14, wherein the template assisted crystallization beads comprise at least one material selected from the group consisting of: a styrenic polymer, an acrylic polymer, or any combination thereof.

20. The method of claim 14, wherein the template assisted crystallization beads are configured to provide a plurality of nucleation sites for crystallization of the scale-forming ions.

* * * * *